US011931659B1

(12) United States Patent
Cecchin et al.

(10) Patent No.: US 11,931,659 B1
(45) Date of Patent: Mar. 19, 2024

(54) ELECTRONIC GAME

(71) Applicant: Elenco Electronics, LLC, Minnetonka, MN (US)

(72) Inventors: Gerald Joseph Cecchin, Buffalo Grove, IL (US); Marc Christoph Lehner, Glenview, IL (US); Tim Conlin, Buffalo Grove, IL (US); Matthew Brian Fuesting, Jr., West Chicago, IL (US)

(73) Assignee: Elenco Electronics, LLC, Minnetonka, MN (US)

( * ) Notice: Subject to any disclaimer, the term of this patent is extended or adjusted under 35 U.S.C. 154(b) by 0 days.

(21) Appl. No.: 18/351,082

(22) Filed: Jul. 12, 2023

(51) Int. Cl.
*A63F 3/00* (2006.01)
*A63F 1/04* (2006.01)

(52) U.S. Cl.
CPC ..... *A63F 3/00643* (2013.01); *A63F 1/04* (2013.01); *A63F 2001/0483* (2013.01); *A63F 2003/00684* (2013.01)

(58) Field of Classification Search
CPC ..... A63F 3/00643; A63F 1/04; A63F 2001/0483; A63F 2003/00684; A63F 3/0457; A63F 2003/00652; G09B 9/00; G09B 23/183
See application file for complete search history.

(56) References Cited

U.S. PATENT DOCUMENTS 4,105,211 A * 8/1978 Wernig ..... A63F 9/0613 273/237
4,119,319 A * 10/1978 Goldfarb ..... A63F 3/00643 273/237
4,772,027 A * 9/1988 Martel ..... A63F 3/00643 273/287
7,144,255 B2 * 12/2006 Seymour ..... H01R 13/627 434/118
7,273,377 B2 9/2007 Seymour
10,252,176 B1 * 4/2019 Cecchin ..... A63H 33/062
2006/0290055 A1 * 12/2006 Matilla ..... A63F 9/1011 273/273
2009/0189533 A1 * 7/2009 Hsu ..... F21S 4/10 315/185 S
2017/0317333 A1 * 11/2017 Seymour ..... H01M 10/0445

FOREIGN PATENT DOCUMENTS

CN 209333212 9/2019

OTHER PUBLICATIONS

Elenco Electronics, LLC, Snap Circuits® Extreme, released by Jan. 1, 2015, https://shop.elenco.com/consumers/snap-circuits-extreme.html.

* cited by examiner

*Primary Examiner* — Michael D Dennis
(74) *Attorney, Agent, or Firm* — Shane Delsman; Godfrey & Kahn, S.C.

(57) ABSTRACT

A game kit for and a method of playing an electric game. The game kit for the electric game includes a board, a power source, at least one electrically activated component and electrically conductive game pieces. The electrically conductive game pieces are used to electrically connect an electrically activated component to the power source.

27 Claims, 23 Drawing Sheets

ELECTRONIC GAME

FIELD

The present disclosure relates generally to the field of games. More particularly, the present disclosure relates to board games that use electrically activated components.

BRIEF DESCRIPTION OF THE DRAWINGS

Embodiments of the electronic game are disclosed with reference to the accompanying exemplary drawings, which are for illustrative purposes. It will be understood by those skilled in the art that one or more aspects of this invention can meet certain objectives, while one or more other aspects can lead to certain other objectives. Other objects, features, benefits and advantages of the present invention will be apparent in the summary and descriptions of the disclosed embodiment(s), and will be readily apparent to those skilled in the art. Such objects, features, benefits and advantages will be apparent from that previously described taken in conjunction with the accompanying figures and all reasonable inferences to be drawn therefrom.

DETAILED DESCRIPTION

Figure 1:
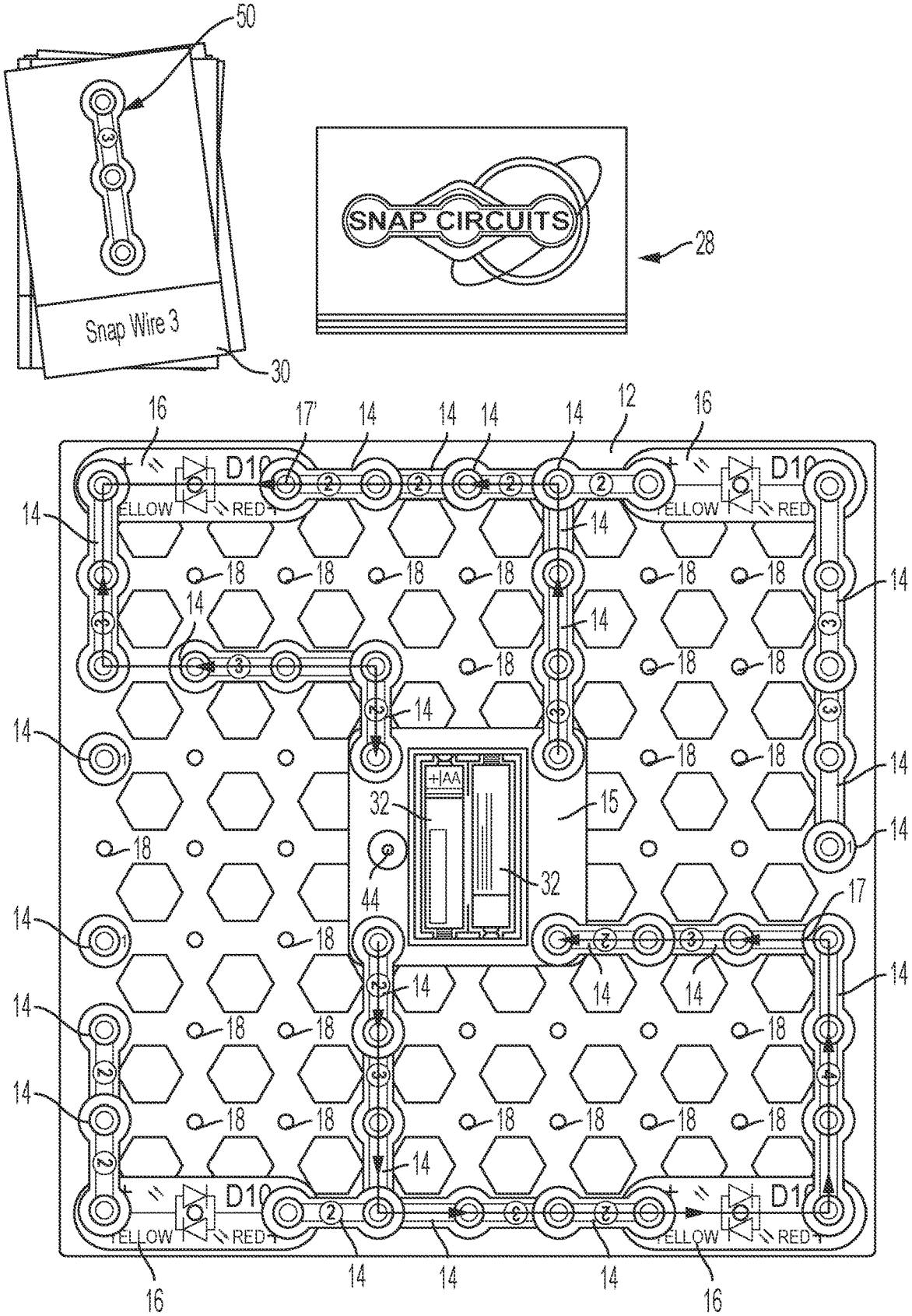
FIG. 1 is a top, plan view of one embodiment of an electric game.

According to one embodiment, a game 10 is configured in which the goal is to complete a circuit. As seen in FIG. 1, a kit for the game 10 may have a board 12 on which game pieces 14 are played. In one embodiment, the kit for the game 10 includes a power source 15, for example a battery pack, and an electrically activated component 16, such as, for example, a light, sound emitter, or fan. The power source could alternatively be a component that is plugged into a wall outlet. One or more players use the game pieces 14 to connect the electrically activated component 16 to the power source 15 to create a circuit 17 such that the electrically activated component is activated, such as, for example, by emitting a light, making a noise or rotating a fan.

Figure 2A:
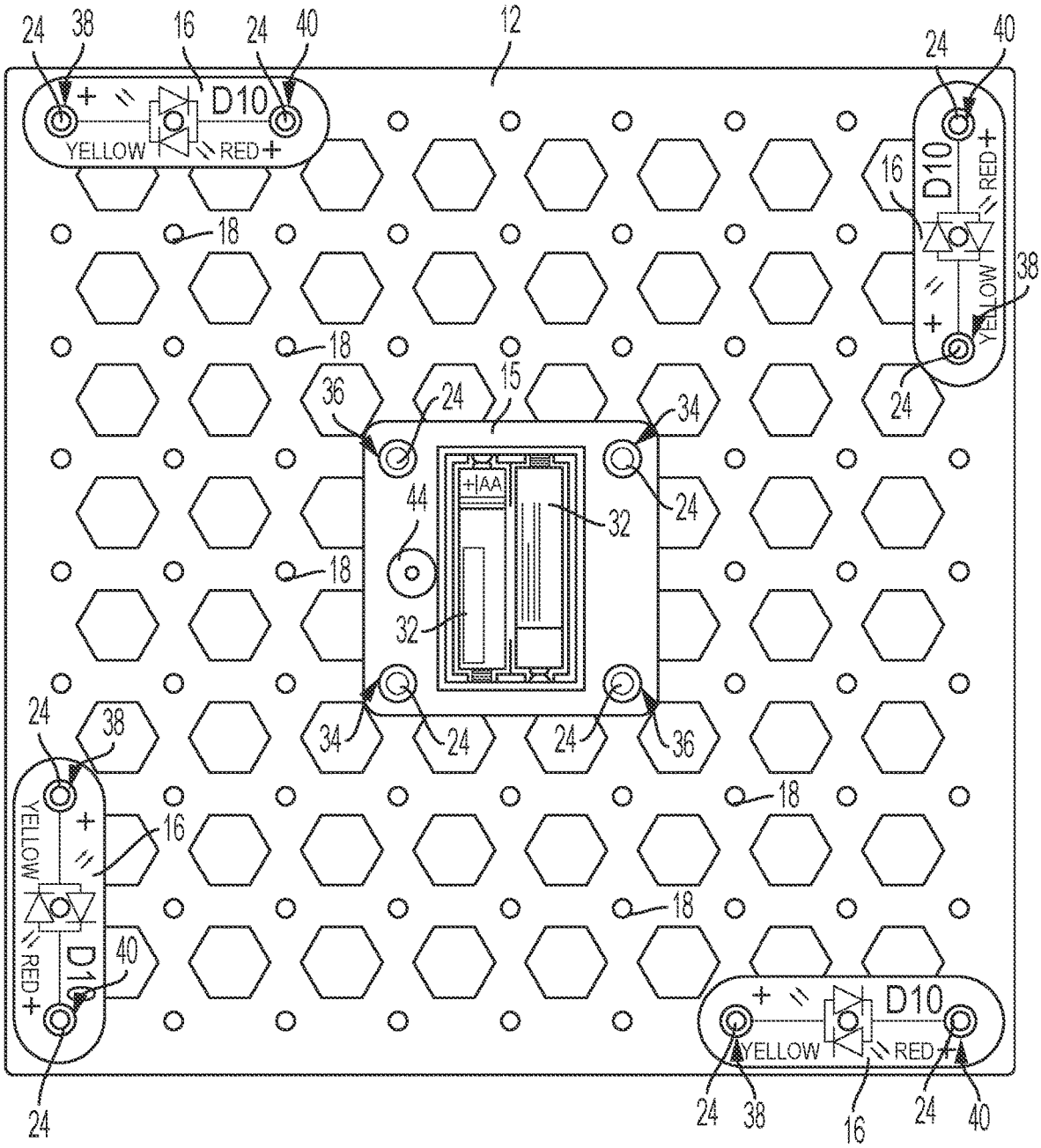
FIG. 2A is a top, plan view of the electronic components and power source in one embodiment for starting the electric game.
Figure 2B:
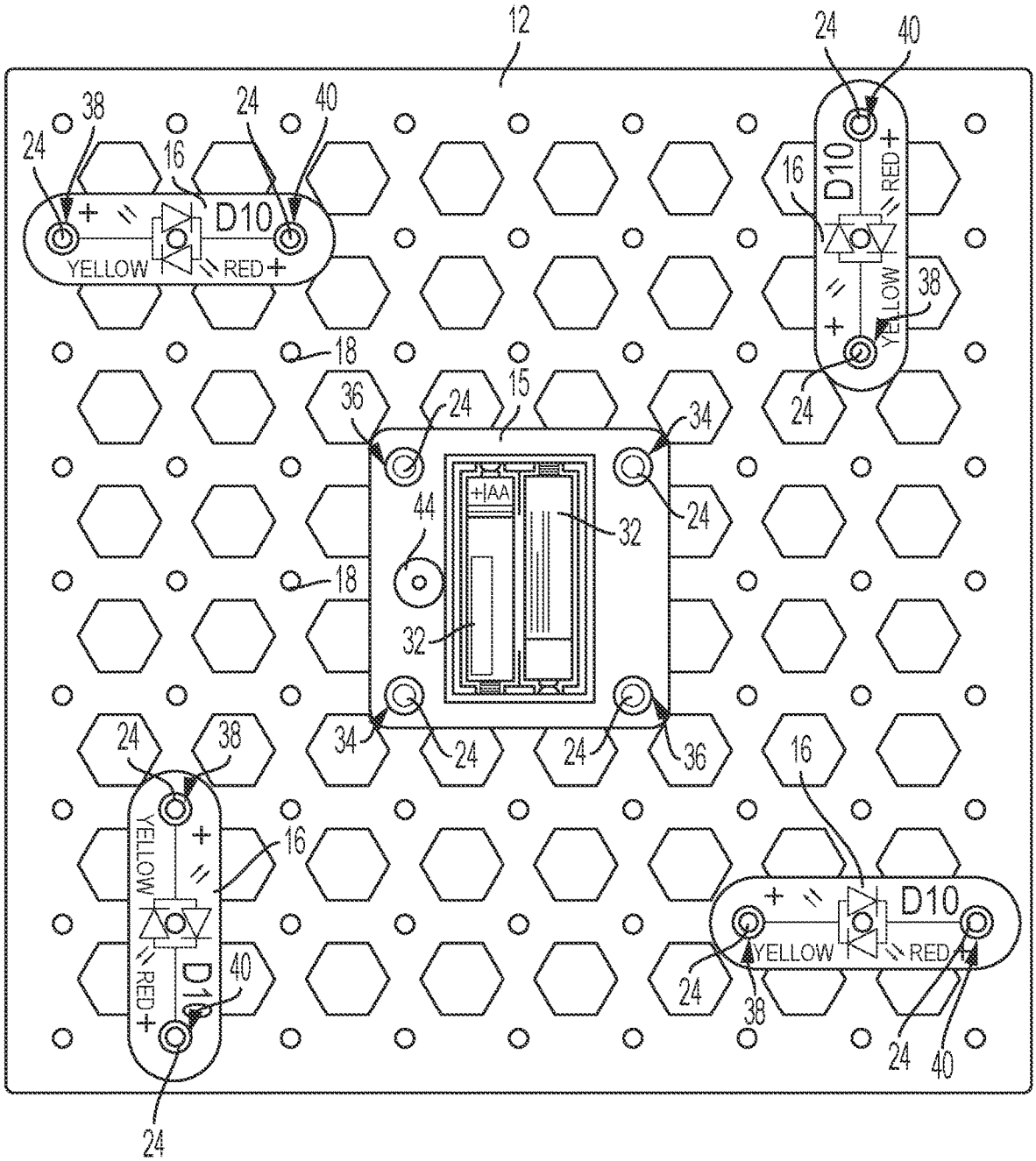
FIG. 2B is a top, plan view of the electronic components and power source in another embodiment for starting the electric game.
Figure 2C:
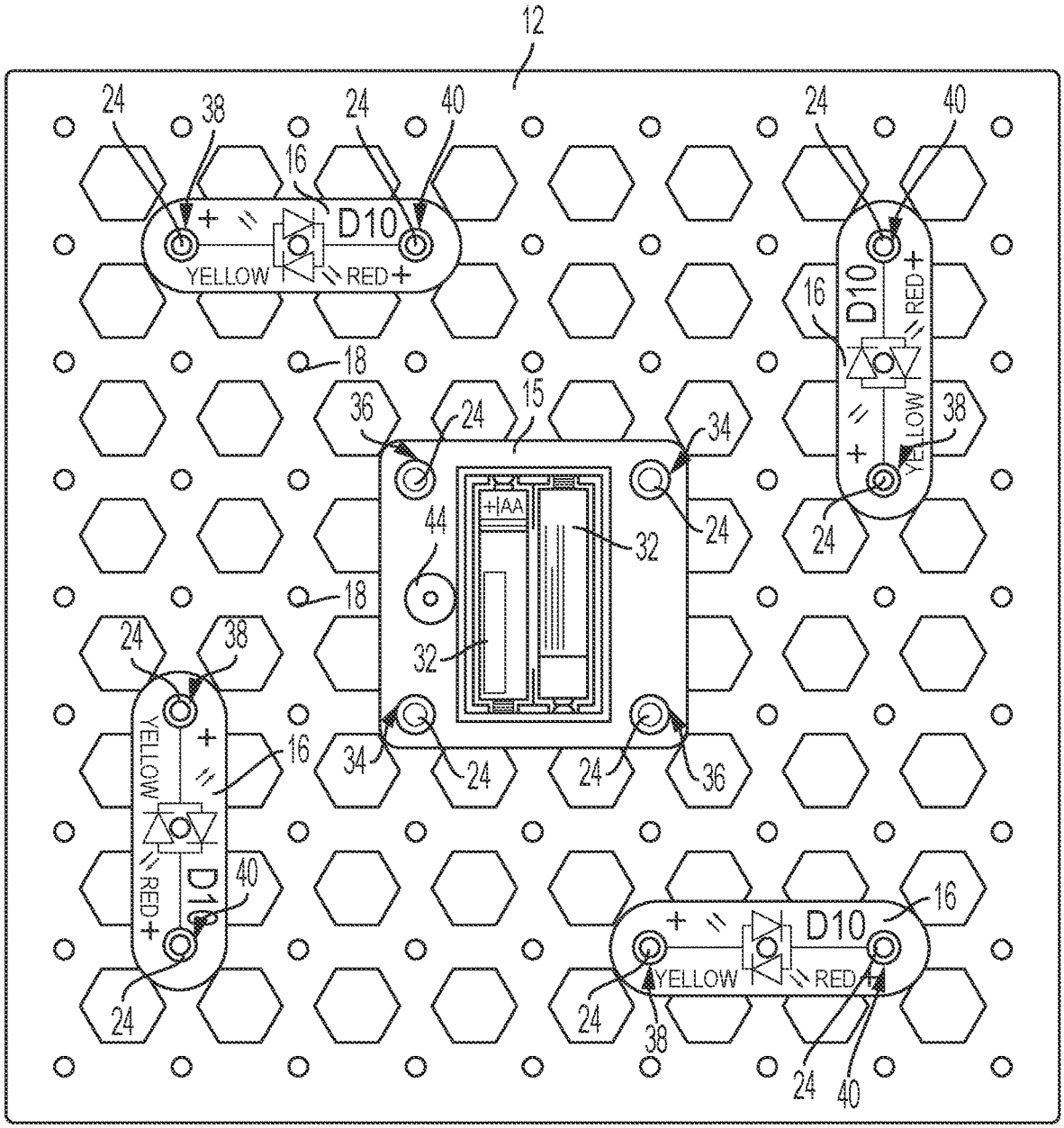
FIG. 2C is a top, plan view of the electronic components and power source in another embodiment for starting the electric game.
Figure 2D:
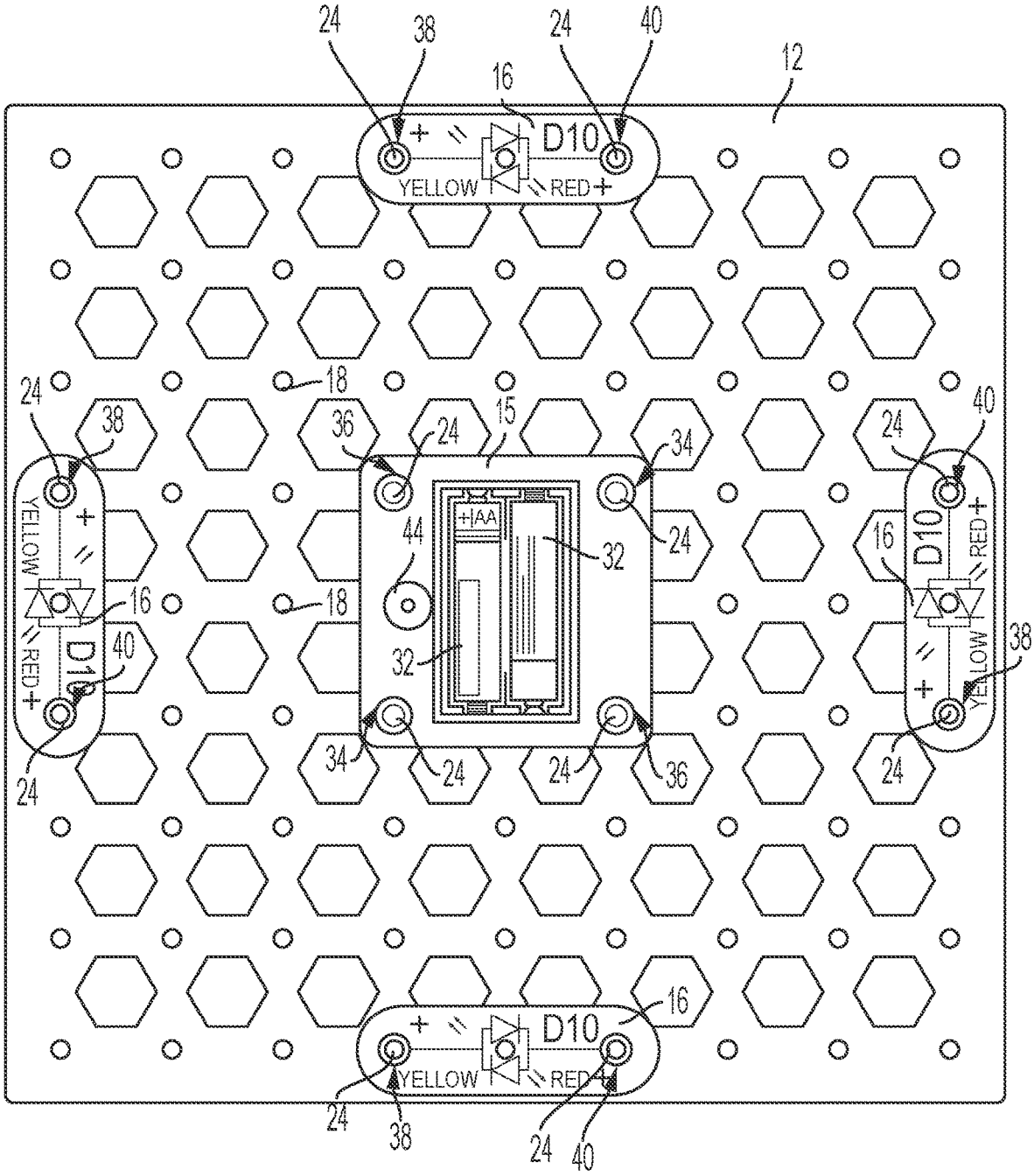
FIG. 2D is a top, plan view of the electronic components and power source in another embodiment for starting the electric game.
Figure 2E:
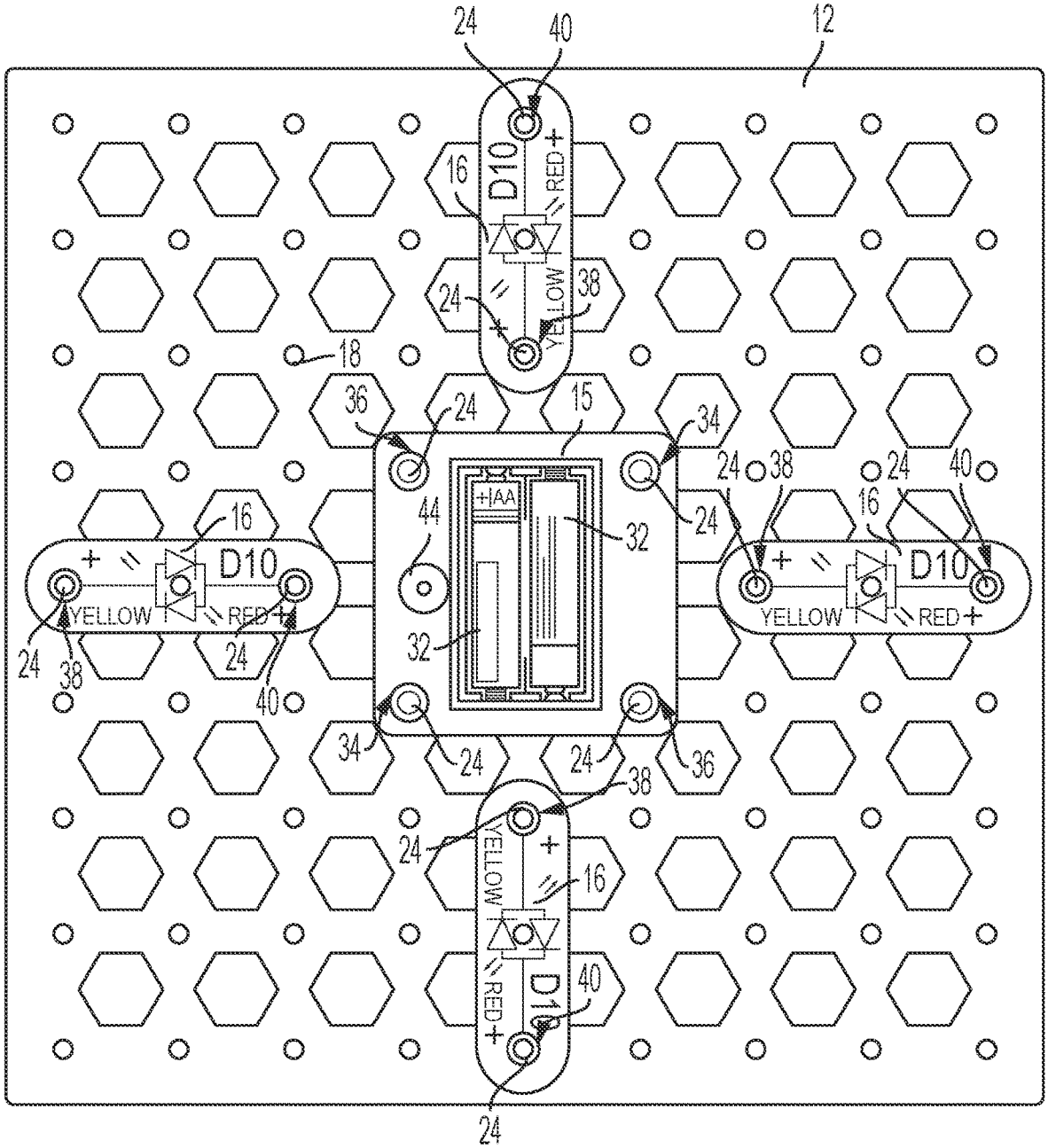
FIG. 2E is a top, plan view of the electronic components and power source in another embodiment for starting the electric game.
Figure 2F:
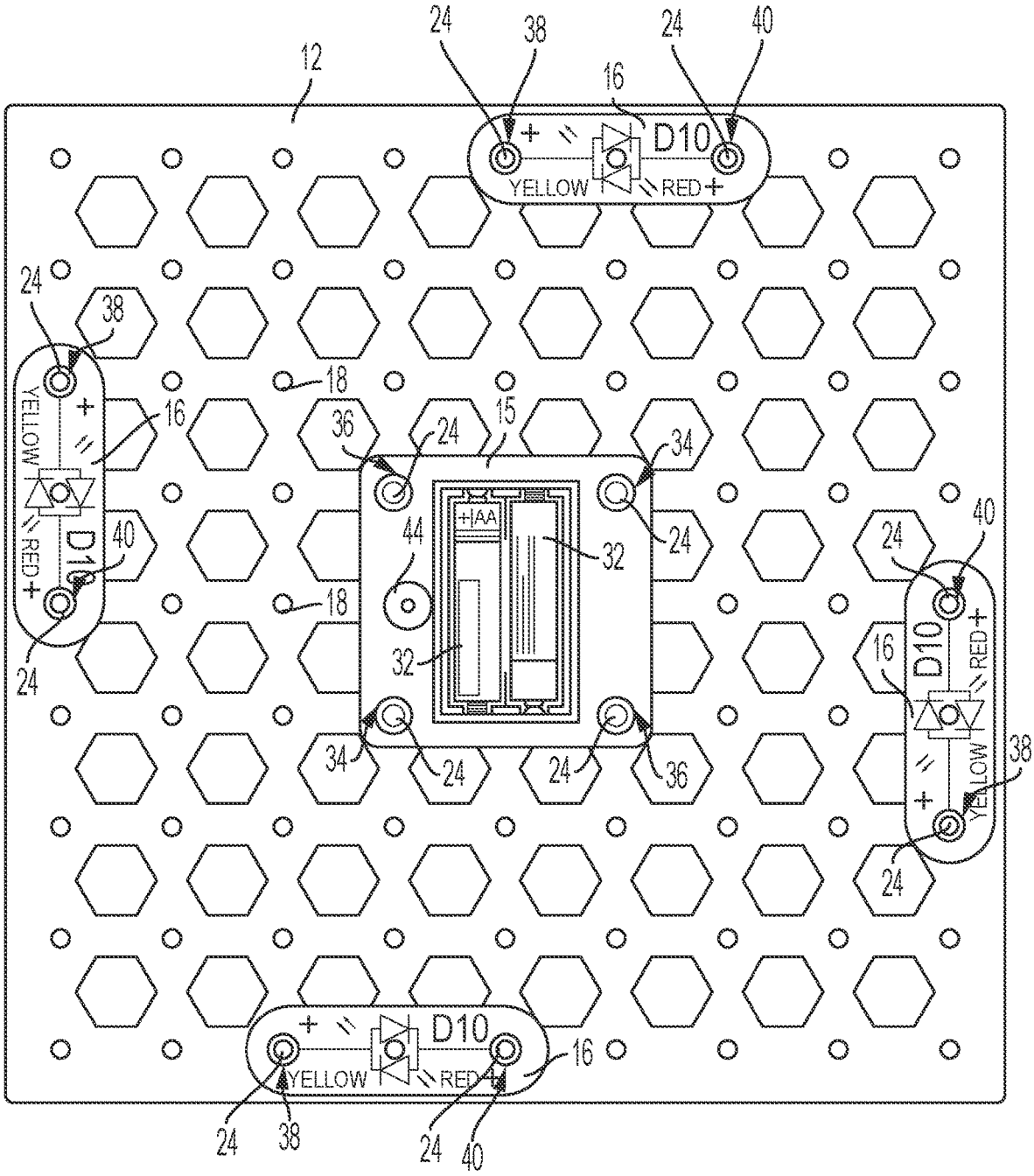
FIG. 2F is a top, plan view of the electronic components and power source in another embodiment for starting the electric game.
Figure 3:
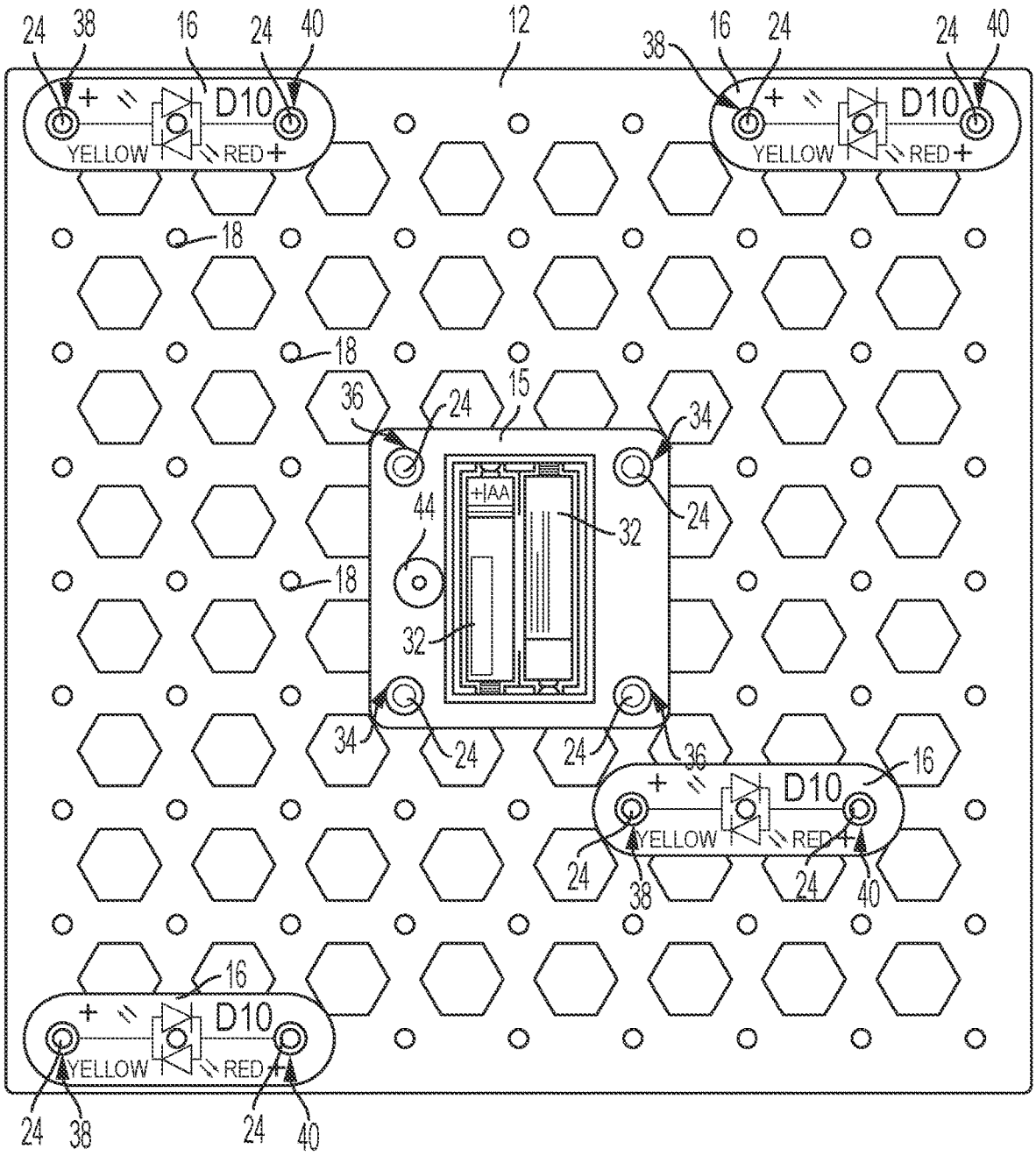
FIG. 3 is a top, plan view of the electronic components and power source in another embodiment for starting the electric game.

In one embodiment seen in FIG. 2A, the power source 15 may be located in the middle of the board 12 and one up to a plurality of electrically activated component(s) 16 located around the outer edge(s) of the board. In one embodiment, the game kit 10 includes four electrically activated component(s) 16. The electrically activated component(s) 16 could also have different colors, such as, for example, yellow, red, green or purple, to help players remember which electrically activated component is theirs. The power source 15 and/or electrically activated component(s) 16 may be secured to the board 12 or may be attached or configured to be selectively attached to the board to permit the power source and/or electrically activated component(s) to be move to different locations. For example, it may be desirable for less skilled players, such as younger players, to start the game 10 with his or her electrically activated component 16 located closer to the power source 15 than another older or more skilled player as seen in FIG. 3. Further, the game play could be altered by, for example, placing and/or moving the power source 15 and/or electrically activated component(s) 16 while playing the game 10, such as, for example, by drawing a game card 30 that instructs the player drawing the game card to place an electrically activated component on the board 12. Further, different starting positions for the power source 15 and/or electrically activated component(s) 16 could be used when playing multiple games, as seen in FIGS. 2A-3.

Figure 4:
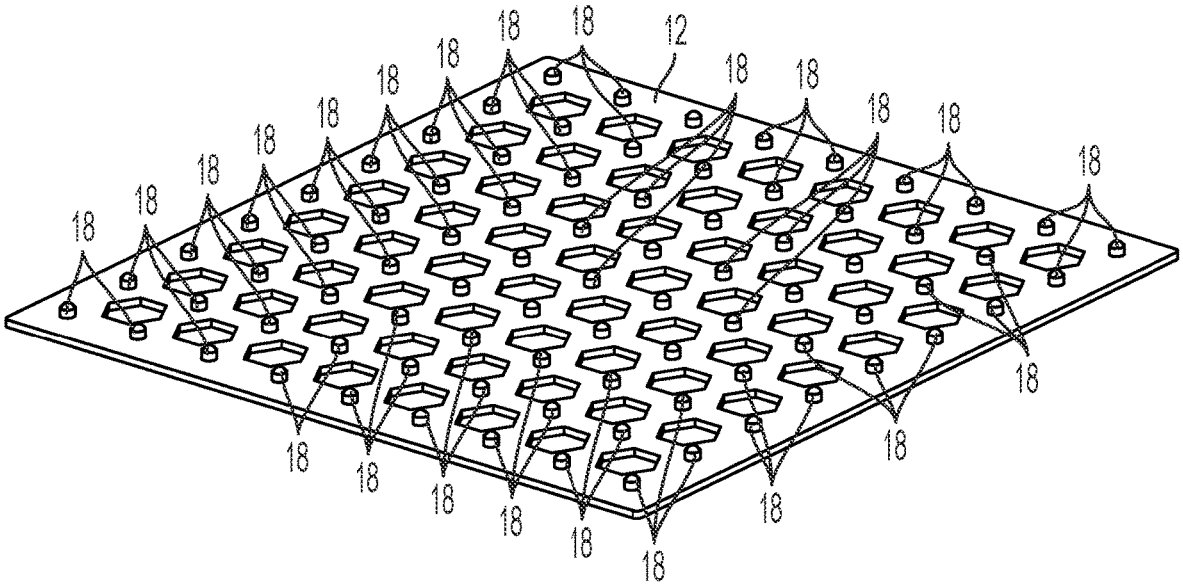
FIG. 4 is a perspective view of a board of the electric game.

The board 12 may be of almost any desirable shape and in the embodiment seen in FIG. 4 is square. The board 12 may include spaces in which game pieces 14 may be placed or could be without defined spaces allowing more freedom and creativity in game piece play. In one embodiment, the board 12 has a grid of projections or pegs 18, such as, for example, base grid, part number 6SCBG available from Elenco Electronics, LLC. In the embodiment seen in FIG. 4, the board 12 is a grid of nine rows of pegs 18 and nine columns of pegs.

Figure 9B:
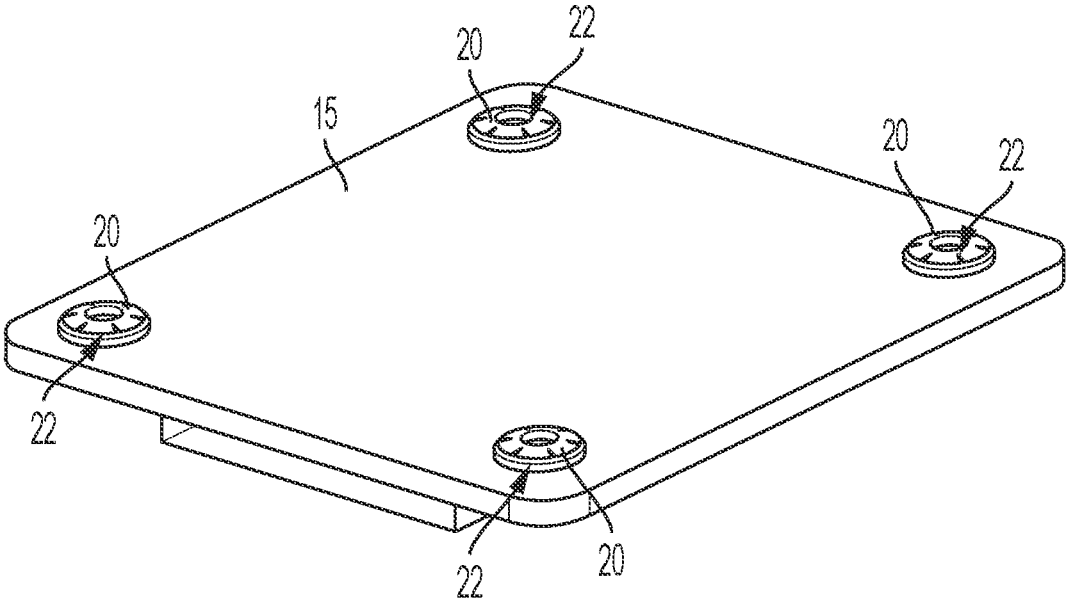
FIG. 9B is a perspective view of the bottom of the power source of FIG. 9A.
Figure 10B:
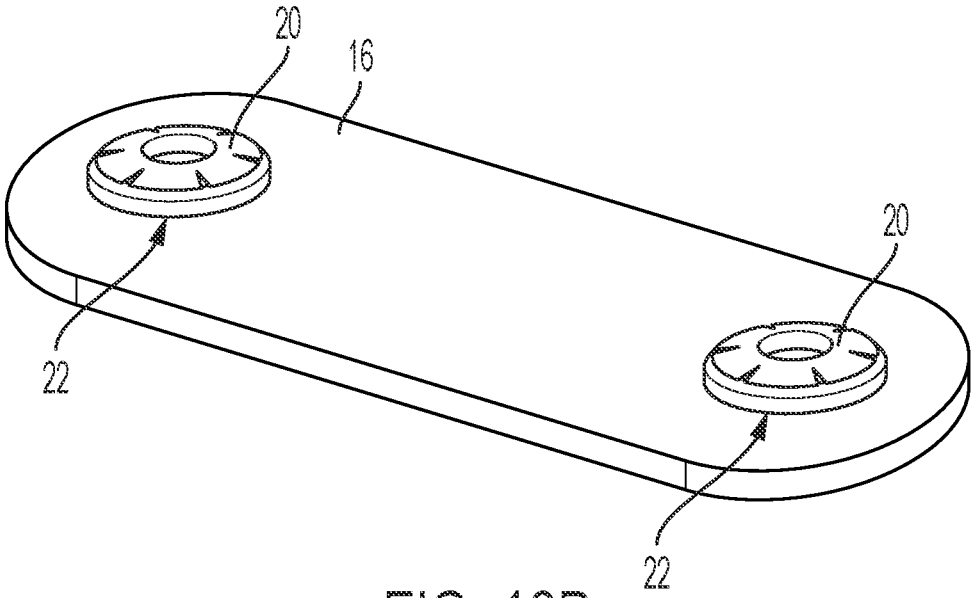
FIG. 10B is a perspective view of the bottom of the electric component of FIG. 10A.
Figure 11:
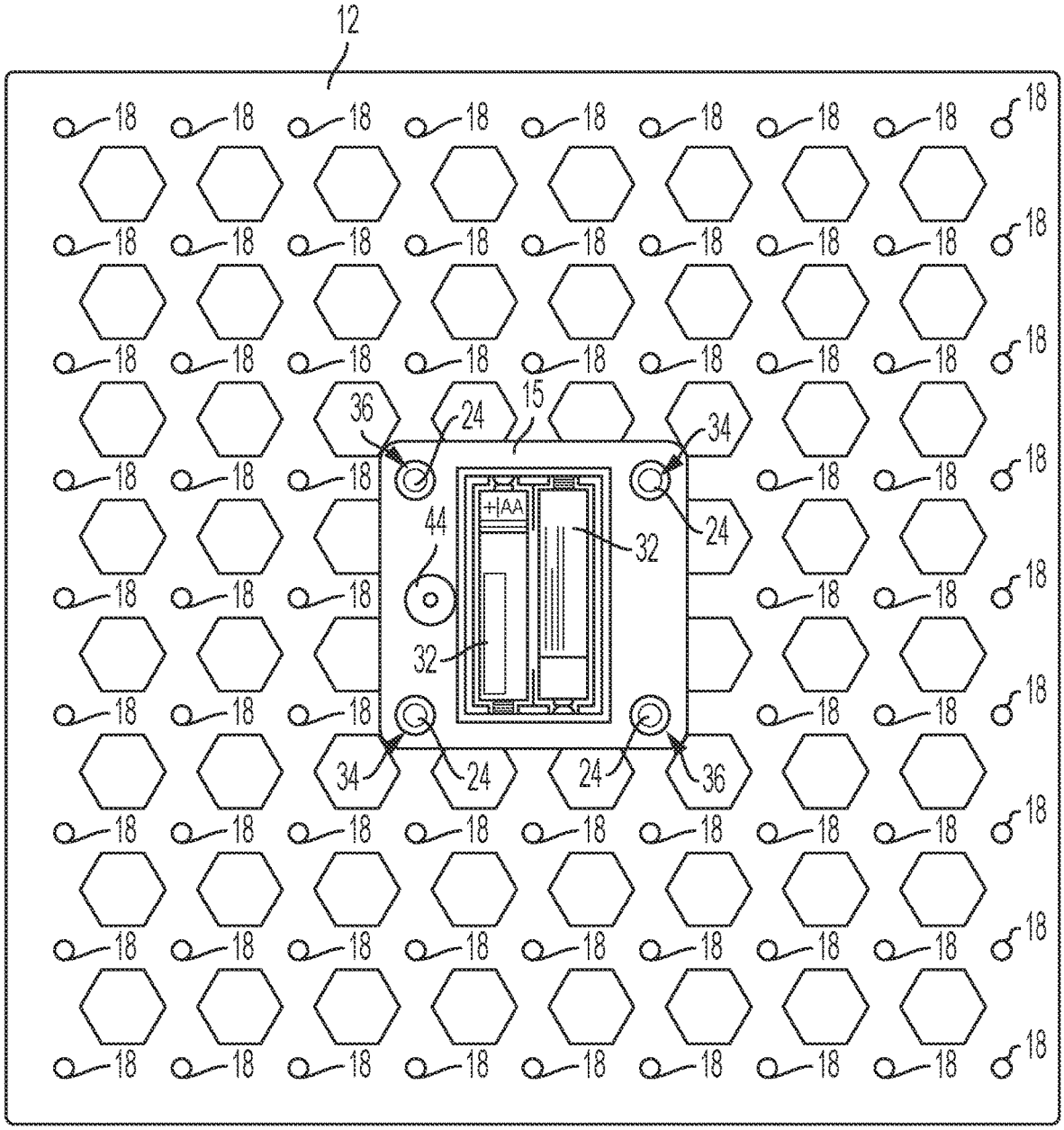
FIG. 11 is a top, plan view of the power source attached to the board.
Figure 12:
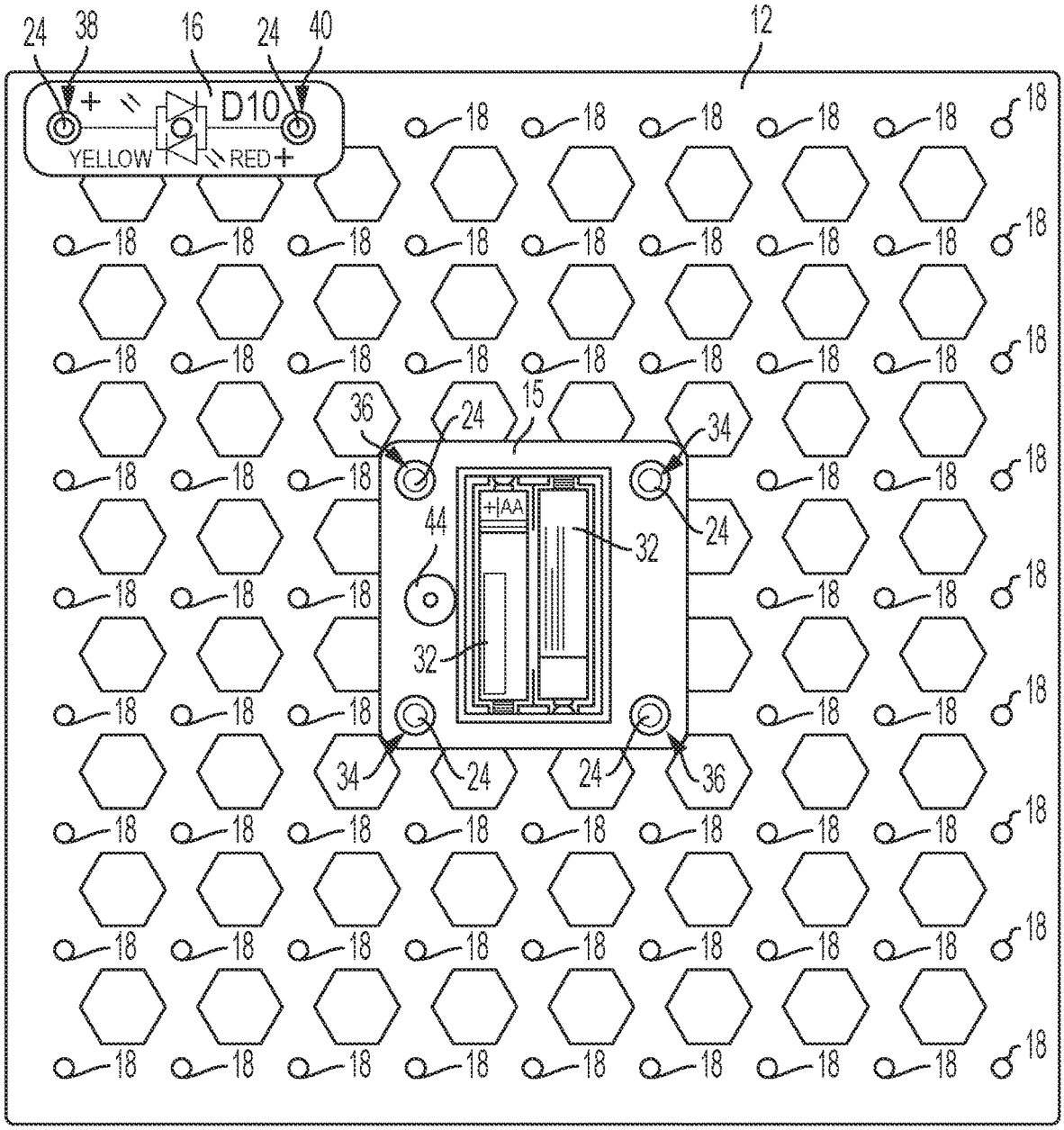
FIG. 12 is a top, plan view of the power source and one electrically activated component attached to the board.

The game pieces 14 may include receptacles 20, as seen in FIGS. 5B, 6B, 7B, 8B, that are configured to receive a projection 18 such that the game pieces may be placed on the board in a grid like fashion as seen in FIG. 1. The power source 15 and/or the electrically activated component(s) 16 may also include receptacles 20, as seen in FIGS. 9B, 10B, to permit the power source and/or the electrically activated component(s) to be selectively attached to the board as seen in FIGS. 11-12. In one embodiment, the board 12 may not permit playing a game piece 14 diagonally.

Figure 5A:
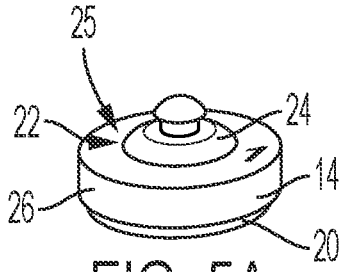
FIG. 5A is a perspective view of the top of one embodiment of a game piece of the electric game.
Figure 5B:
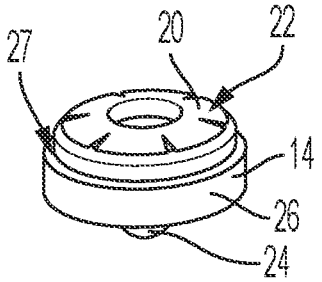
FIG. 5B is a perspective view of the bottom of the game piece of FIG. 5A.
Figure 6A:
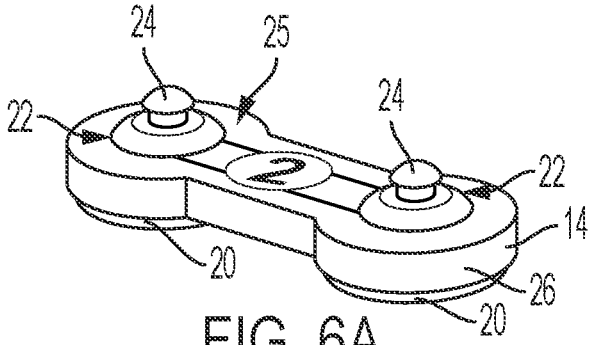
FIG. 6A is a perspective view of the top of another embodiment of a game piece of the electric game.

The game 10 includes a plurality of games pieces 14 and, in one embodiment, the plurality of games pieces are of varying lengths. For example, the plurality of games pieces 14 could include a first length, such as 1 Snap Wires (FIGS. 5A-5B), a second length, such as 2 Snap Wires (FIGS. 6A-6B), a third length, such as 3 Snap Wires (FIGS. 7A-7B) and a fourth length, such as 4 Snap Wires (FIGS. 8A-8B). In one embodiment the game 10 includes four 1 Snap Wires, sixteen 2 Snap Wires, fourteen 3 Snap Wires and four 4 Snap Wires, although more of less of each game piece 14 could be used as desired, such as, for example, based on the number of players, without defeating the spirit of the invention.

Figure 20:
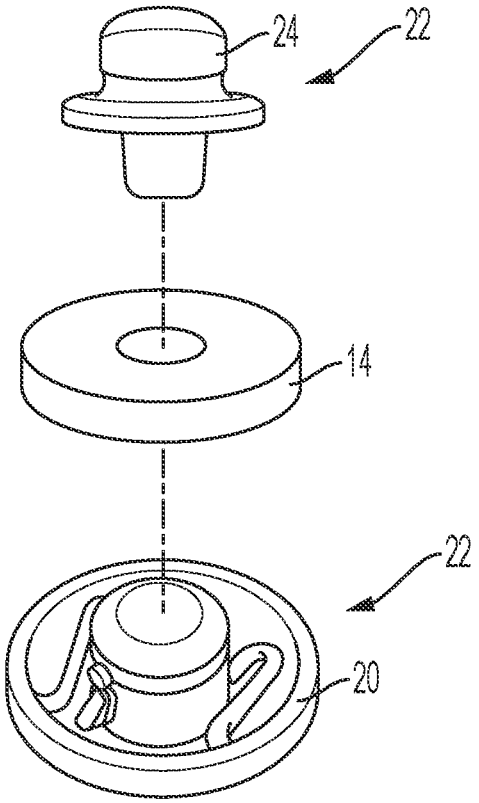
FIG. 20 is an exploded perspective view of one embodiment of a game piece and the connector.

Some of the game pieces 14 may include connectors 22, e.g. a receptacle 20 and plug 24 as seen in FIG. 20, located just at the first end and second end of the body 26, such as 2 Snap Wire, part number 65C02 available from Elenco Electronics, LLC, and some may include one or more connectors 22, such as a plug 24, located at midpoints along the body of the game piece, such as a 3, 4, 5 or 6 Snap Wire, part numbers 6SC03, 6SC04, 6SC05, 6SC06, available from Elenco Electronics, LLC. The game piece 14 could also include just one connector 22 such as a 1 Snap Wire, part number 6SC01 available from Elenco Electronics, LLC. In one embodiment, the game pieces 14 can be selectively attached to one another in a stackable manner, such as one game piece stacked above another game piece when the game pieces are selectively attached.

At least some of the game pieces 14 are electrically conductive such that the game pieces can permit electricity to flow from a first end of the game piece to a second end of the game piece. The electrically conductive game pieces 14 may also include connectors 22, as seen in FIGS. 5A, 6A, 7A, 8B, that permit one game piece to be connected to another game piece and/or the power source 15 and electrically activated component 16. In one embodiment, the connector 22 is a plug 24 located on a first or top surface 25 of the body 26 of the game piece 14 and a receptacle 20 located on a second or bottom surface 27 of the body of the game piece opposite the plug. The receptable 20 may be configured to selectively receive a plug 24 such that game pieces 14 can be selectively attached to one another.

Figure 6B:
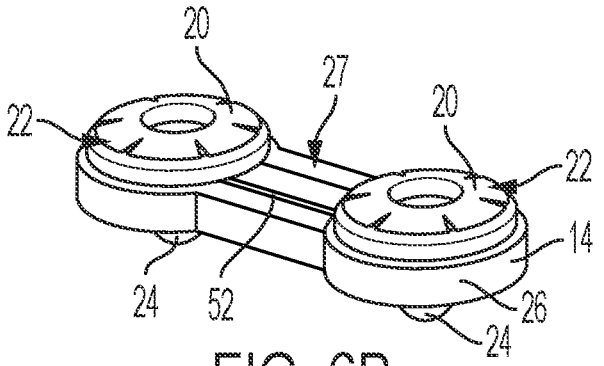
FIG. 6B is a perspective view of the bottom of the game piece of FIG. 6A.
Figure 7A:
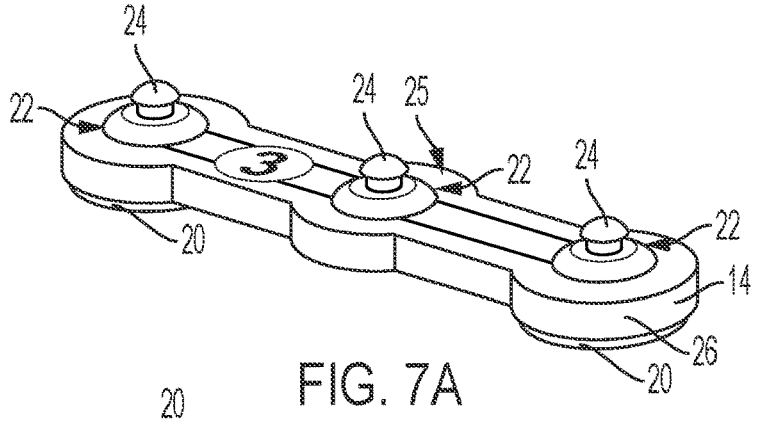
FIG. 7A is a perspective view of the top of another embodiment of a game piece of the electric game.
Figure 7B:
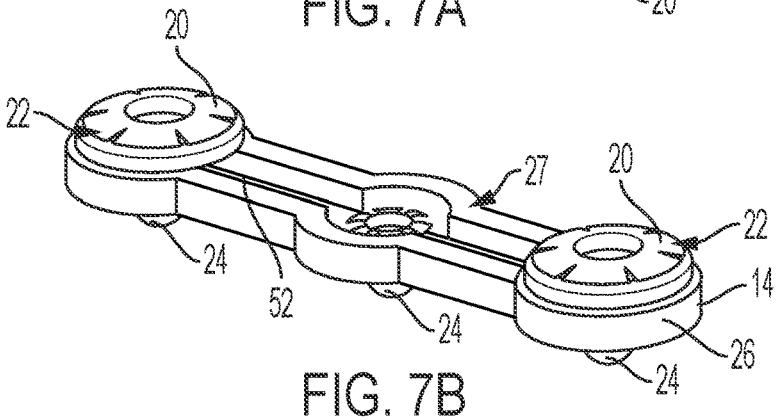
FIG. 7B is a perspective view of the bottom of the game piece of FIG. 7A.
Figure 8A:
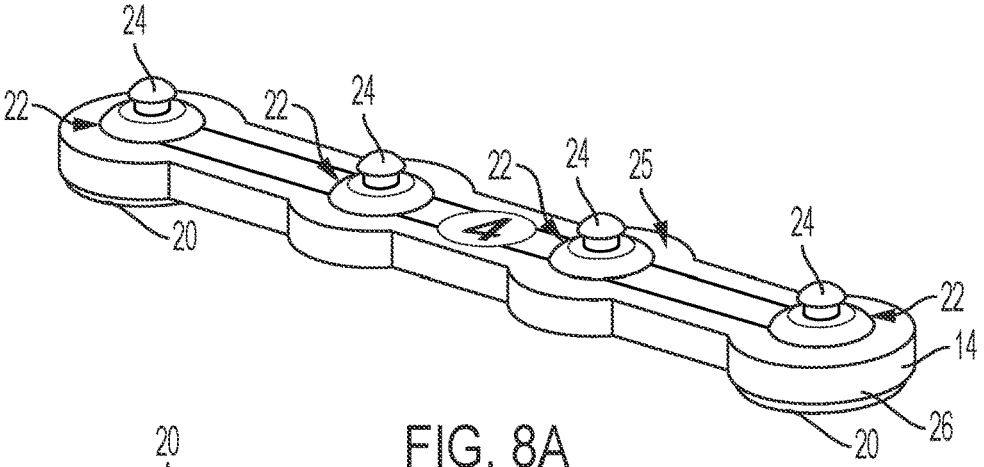
FIG. 8A is a perspective view of the top of another embodiment of a game piece of the electric game.
Figure 8B:
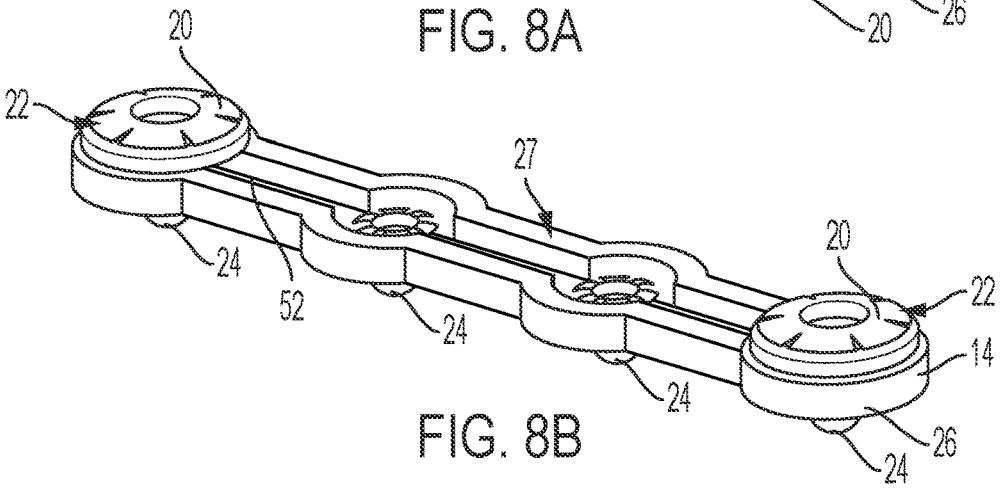
FIG. 8B is a perspective view of the bottom of the game piece of FIG. 8A.

In one embodiment seen in FIGS. 6B, 7B, 8B, the game piece 14 includes a conductive strip, such as a metal wire 52, run through the body 26. The receptables 20 and/or plugs 24 may also be electrically conductive, such as being made from metal. The receptables 20 and/or plugs 24 may be attached to the conductive strip such that when a receptable 20 or plug 24 receives electricity, it is transferred across the conductive strip and to the other receptables and/or plugs connected thereto. When the receptable 20 of a game piece 14 receives a plug 24 from another game piece, the game pieces are electrically connected and electricity can flow from one game piece to a second game piece.

Other game pieces 14 could be used in addition or alternatively to the snap wires such as switches, for example part numbers 6SCS1, 6SCS2 available from Elenco Electronic, LLC, resistors, such as 6SCRP, 6SCR1 available from Elenco Electronic, LLC, and/or jumper wires, such as 6SCJ1, SSCJ2 available from Elenco Electronic, LLC.

Figure 9A:
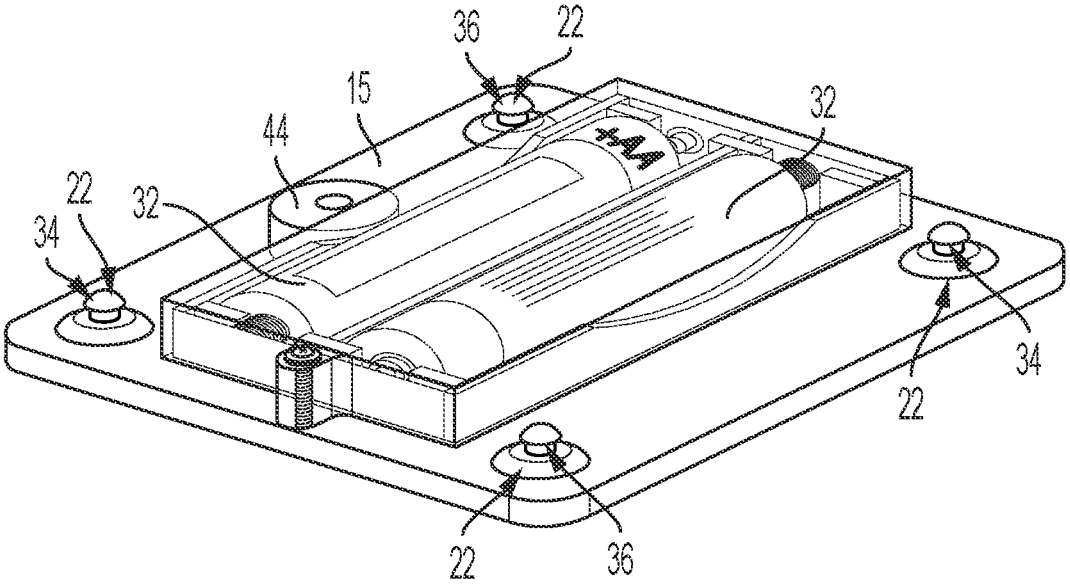
FIG. 9A is a perspective view of the top of a power source of the electric game.

The power source 15 could also include one or more connectors 22 to permit the game pieces 14 to be selectively attached to the power source. For example, battery holder, part number 6SCB1, available from Elenco Electronic, LLC could be used. Part number 6SCB1 has a first power, anode or positive connector 34, e.g. a first power plug, and a second power, cathode or negative connector 36, e.g. a second power plug. In the embodiment seen in FIG. 9A, the power source 15 is a battery holder with a pair of positive connectors 34 and a pair of negative connectors 36 to permit the players more flexibility in creating a circuit 17 with an electrically activated component 16 and to make the distance between each player's electrically activated component and a positive connector and a negative connector more equal and fairer. In one embodiment, each one of the pair of positive connectors 34 is located on opposite corners of the power source 15 and each one of the pair of negative connectors 36 is located on opposite corners of the power source.

Figure 13:
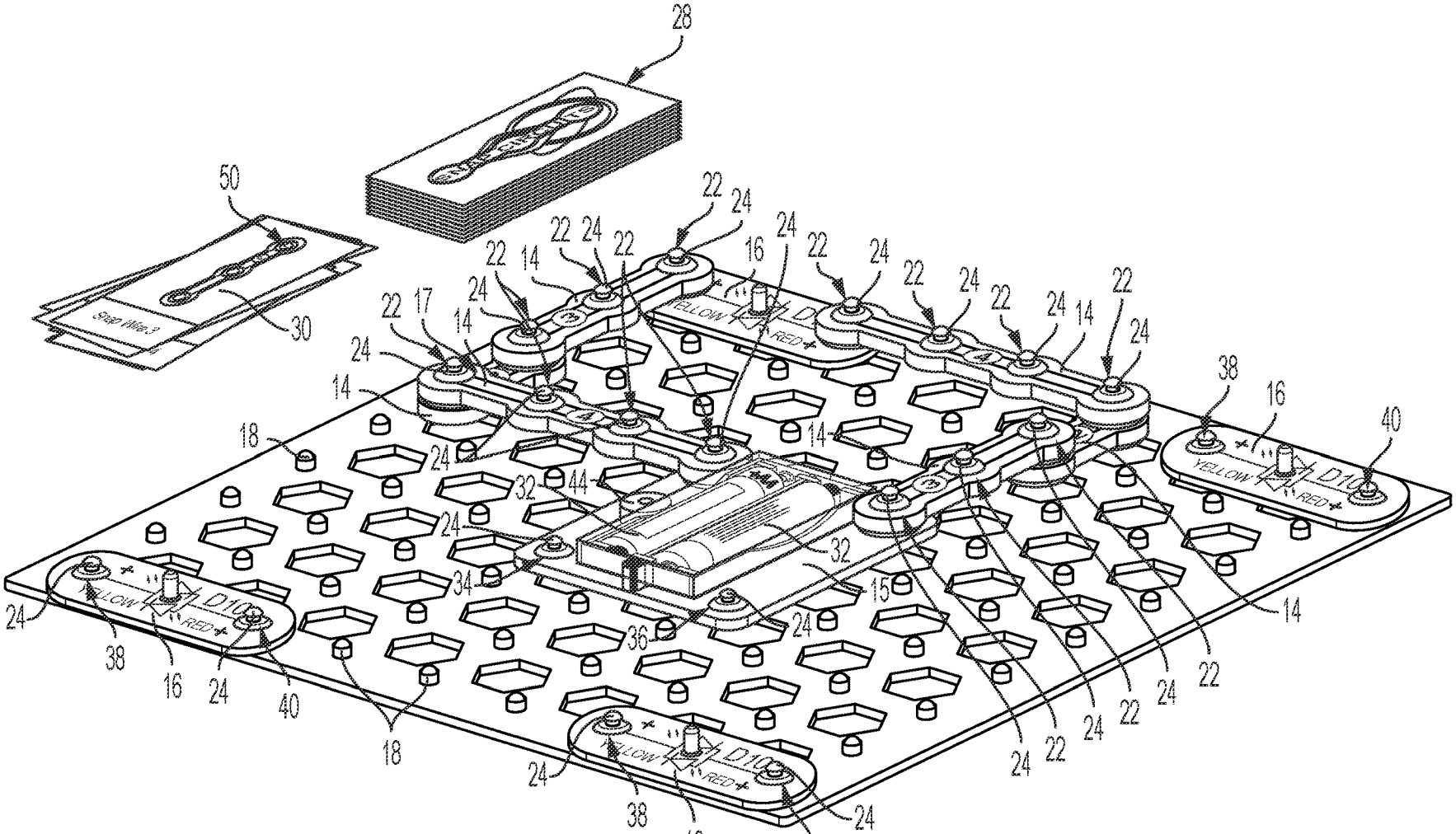
FIG. 13 is a perspective view of one embodiment of the electric game.
Figure 14:
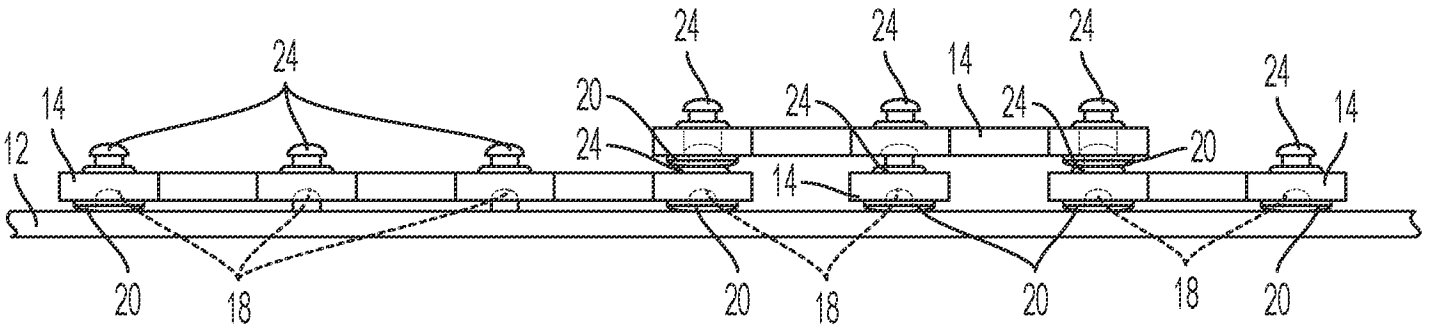
FIG. 14 is side elevation view of a number of game pieces attached to one another and the board.
Figure 15:
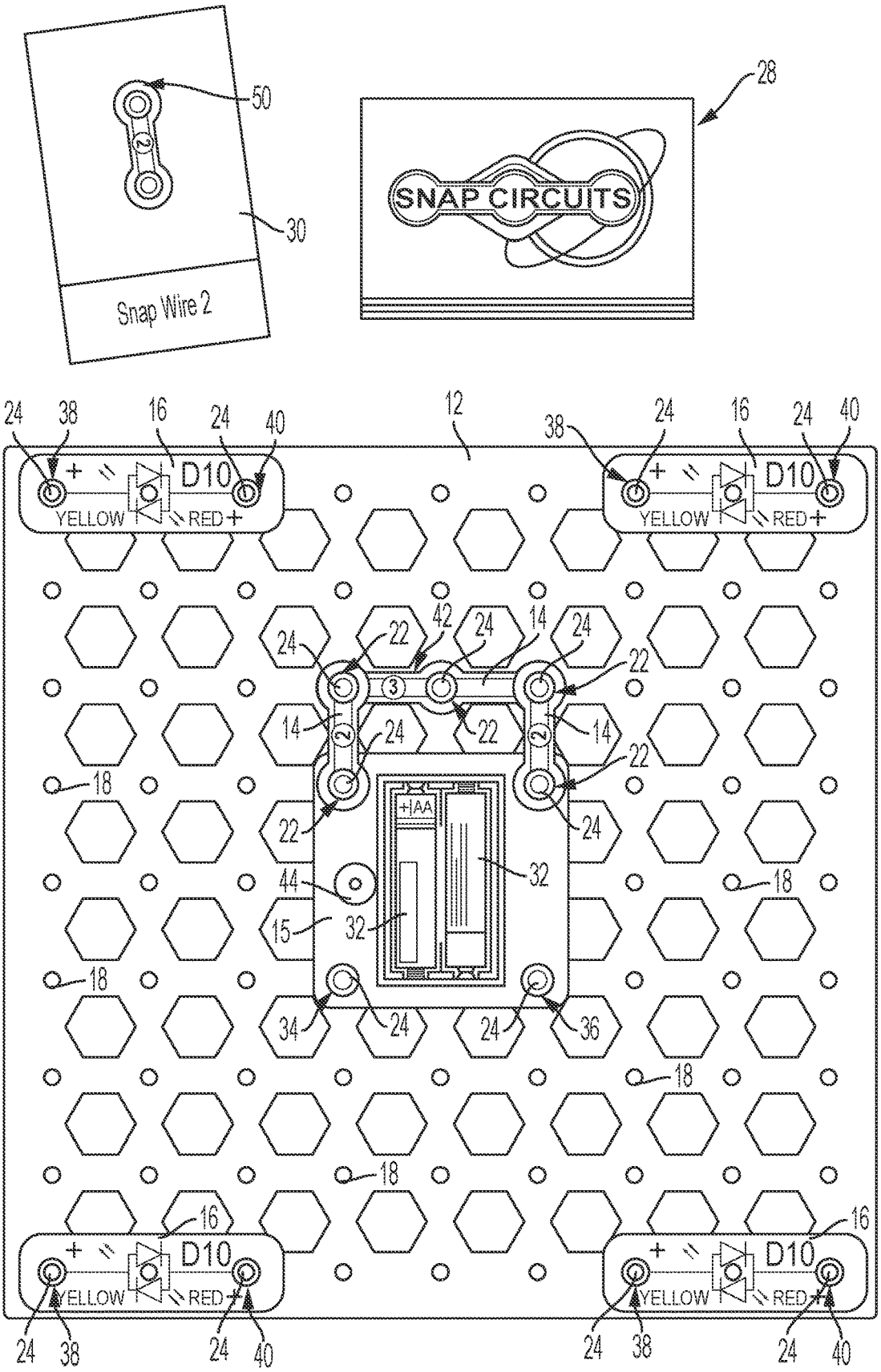
FIG. 15 is a top, plan view of a short circuit created in the electric game.

The electrically activated component 16 could also include one or more connectors 22 to permit the game pieces 14 to be selectively attached to the electrically activated component. For example, LED component, part number 6SCD1, available from Elenco Electronic, LLC could be used. A first component connector, in this instance a first component plug 38, of the LED component is electrically connected using the game pieces 14 to the one of the positive connectors 34 of the power source 15 and a second component connector, in this instance a second component plug 40 of the LED component must be electrically connected using the game pieces 14 to the one of the negative connectors 36 of the power source to create a circuit 17 as seen in FIG. 13. Each of the first component plug 38 and second component plug 40 is configured to be selectively received by a receptacle 20 of a game piece 14 to selectively attach the game piece to the electrically activated component 16

Figure 10A:
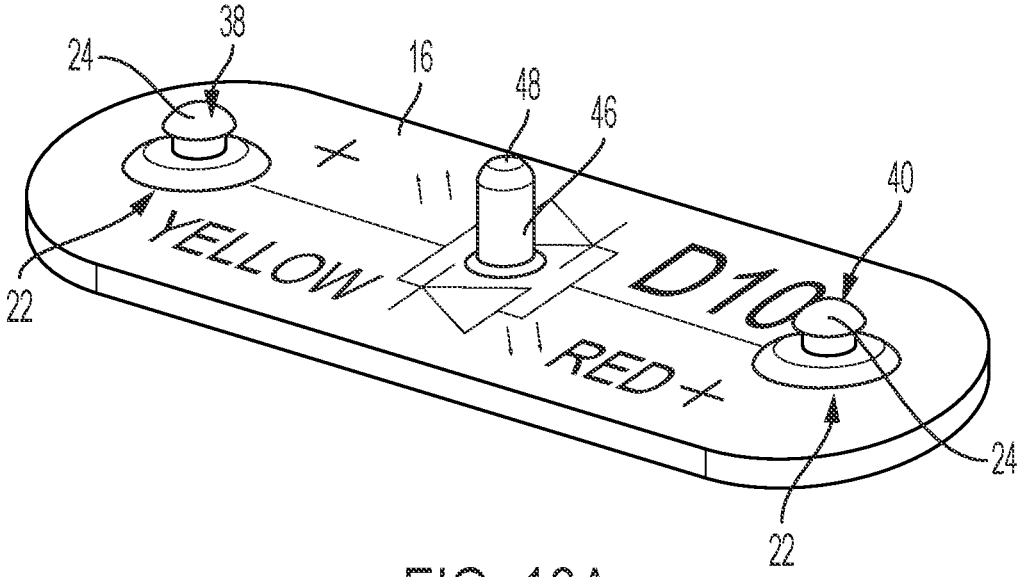
FIG. 10A is a perspective view of the top of an electric component of the electric game.
Figure 16:
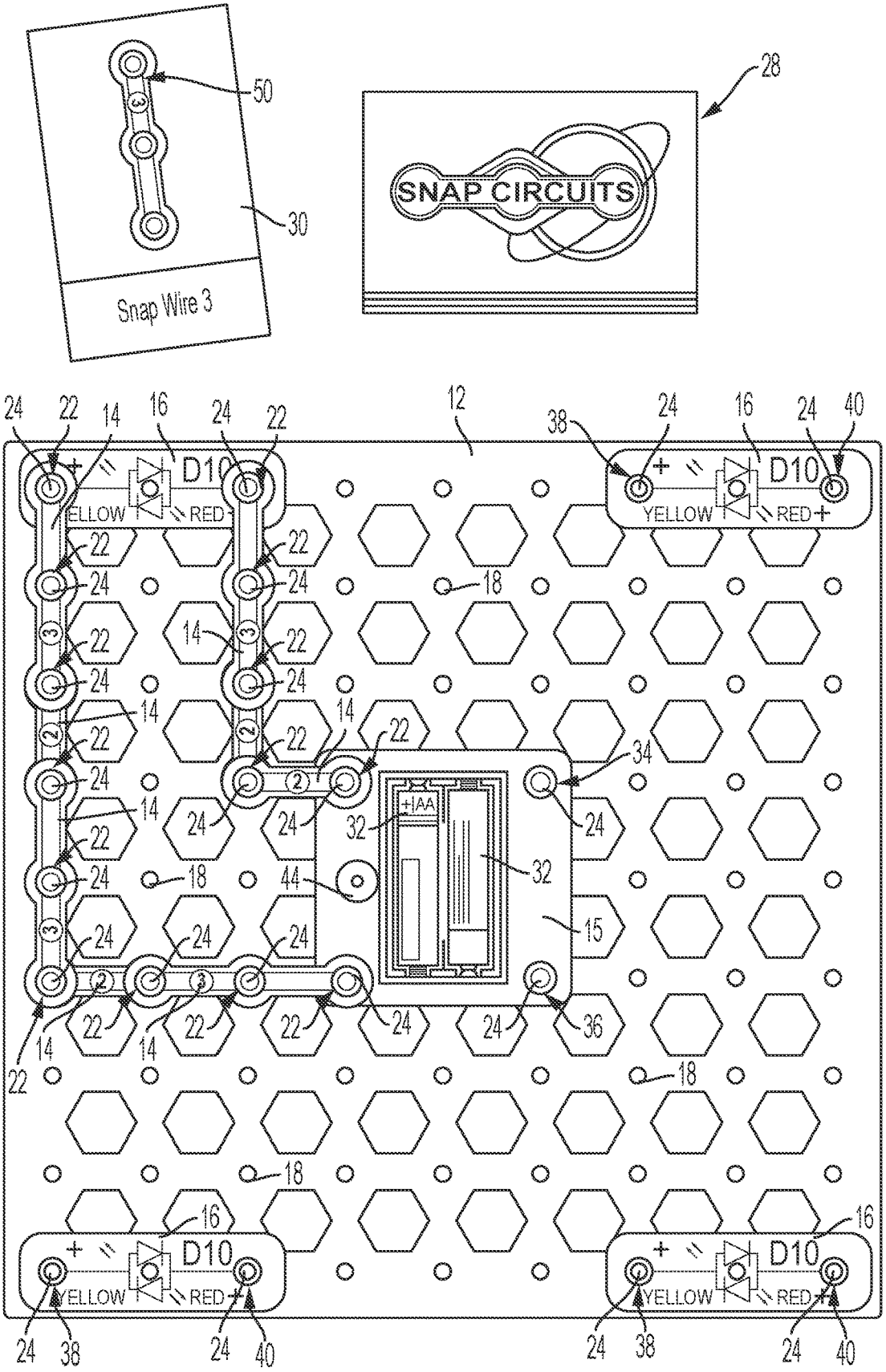
FIG. 16 is a top, plan view of a circuit created in the electric game.

In an alternative embodiment, the electrically activated component 16 is a red/yellow bi-color LED component 46 as seen in FIG. 10A and, in one embodiment a red LED and yellow LED, connected in parallel and with reverse polarities. When voltage is applied in a first direction, for example, the first connector 38 of the LED component is electrically connected using the game pieces 14 to the one of the positive connectors 34 of the power source 15 and the second connector 40 of the LED component is electrically connected using the game pieces 14 to the one of the negative connectors 36 of the power source, as seen in FIG. 16, a circuit 17 is created and the first LED 46 is activated by emitting a light, but the second LED 48 is not activated and does not emit a light. And when voltage is applied in a second direction, for example, the first connector 38 of the LED component is electrically connected using the game pieces 14 to the one of the negative connectors 36 of the power source 15 and the second connector 40 of the LED component is electrically connected using the game pieces 14 to the one of the positive connectors 34 of the power source, as seen in FIG. 1, a circuit 17' is created and the second LED 48 emits a light, but the first LED 46 does not emit a light. In one embodiment, the winner of the game 10 is the player that makes a circuit 17 with voltage applied across the electrically activated component 16 in a certain direction such that a specific LED is activated or lighted. In another embodiment, the winner of the game 10 is the player that makes a circuit 17 with voltage applied across the electrically activated component 16 in either direction.

Other electrically activated components 16 could be used in addition or alternatively to the LED component such as, for example a lamp, part number 6SCL1, a noise making component, horn part number 6SCW1 or melody integrated circuit part number 6SCU32, and/or a motor and/or fan, such as part number 6SCM1 and/or 6SCM1F, available from Elenco Electronic, LLC.

The game 10 could also include a game piece 14 that indicates when a player has created a short circuit 42. A short circuit 42 can be created, for example, when the positive receptacle 34 on the power source 15 is electrically connected to the negative receptacle 36 on the power source without an electrically activated component 16 electrically connected within that path. In one embodiment, the power source 15 includes a buzzer 44 that emits a sound when a short circuit 42 has been created. In an alternative or additional embodiment, the game 10 could include a game piece that indicates when a player has created a short circuit 42, but illuminating a light.

Multiple game sets, for example, board 12, electrically activated components 16 and/or game pieces 14, can be combined to permit more players to play the game 10 or make the distance between the power source 15 and the electrically activated components greater, requiring more game pieces to complete the circuit 17.

The game 10 can be played either in a single player mode or in a multiplayer mode. The multiplayer mode, each player takes turns placing game pieces 14. In one embodiment, a plurality or deck of game cards 28 is used. Each player, on his or her turn, draws a game card 30 and follows the instruction or direction of the game card. For example, the game card 30 could have the indicia 50 of the game piece 14 the player must play on the board 12 located on one side of the game card as seen in FIG. 16. The deck of game cards 28 could also include other instructions such as, but not limited to, skip the turn of the player drawing the game card, allowing the player drawing the game card to select another player to have his or her turn skipped, allowing the player drawing the game card to remove or move a game piece 14 on the board 12 (even a different player's game piece) or to turn off or on a switch (even if played by a different player).

In one embodiment, the deck of game cards 28 includes forty-eight game cards including forty-two game cards that identify which piece the player must use, two game cards that skip the player's turn that drew the game card, two game cards that allow the player that drew the game card to skip another player's turn, and two game cards that allow the player that drew the game card to move one game piece. If the entire deck of game cards 28 is used, the deck can be shuffled and play resumed.

In one embodiment, after all game cards 30 in the deck of game cards 28 is used once, if a player draws a game card that indicates a game piece 14, the player must move the game piece indicated on the game card from a first position on the board 12 to a second position on the board. In another embodiment, after all game cards 30 in the deck of game cards 28 is used at least once, if a player draws a game card that indicates a game piece 14, the player must move two of the game piece indicated on the game card from a first position on the board 12 to a second position on the board. In yet another embodiment, after all game cards 30 in the deck of game cards 28 is used at least once, if a player draws a game card that indicates a game piece 14, the player must remove the game piece indicated on the game card from the board 12. In yet another embodiment, after all game cards 30 in the deck of game cards 28 is used at least once, after a set number of game cards that do not indicate a game piece 14 are drawn, such as three game cards, the rules for the game cards could change, such as, for example, the player must move two of the game piece indicated on the game cards thereafter drawn from a first position on the board 12 to a second position on the board. Each of the embodiments for playing a game card 30 could be used during the entire game, regardless of how many times the deck of game cards 28 is used, or a different embodiment could be used each time the deck is reused.

Randomized turn instructions, other than game cards 30, could be used to provide instructions for a player's turn including, but not limited to, using one or more dice in which the number rolled indicates what the instruction is or using one or more dice that have a reference (such as an image) to one of the different game pieces 14 on one or more sides of the deice. Players could take turns placing a game piece 14 on the board 12 based on receiving randomized turn instructions (e.g. rolling a dice), following the randomized turn instructions including by selecting a game piece identified by the randomized turn instructions and playing the game piece on the board.

In another embodiment, instead of drawing a game card 30 on a player's turn, each player could be dealt a number of game cards at the start of game play, by of example 3, 4 or 5 game cards, and each player selects a game card to play from the cards dealt to him or her, e.g. the player's "hand," on his or her turn. The player may then be able to draw a new game card 30 from the deck of game cards 28 and add it to the player's hand. In yet another embodiment, the player whose turn it is could chose to either draw a new game card 30 from the deck of game cards 28 or select the game card that was played by the previous player instead of playing a game card. Some cards, such as, for example, the skip your turn cards, could either be taken out before the game, or treated like a select another person's turn to skip or a skip the next player's turn.

In another embodiment, the board 12 may have spaces with different values. For example, numbers may be located next to pegs 18 or the pegs could be color coded, with each color indicating a different value. When a circuit 17 is created with the electrically activated component 16, all the values for the pegs 18 used to complete the circuit are added to together to determine to the total value. Values could be positive or negative. In another embodiment, if a circuit 17 has a game piece 14 that is stacked on top of another game piece, the value could be modified, such as, for example, doubled.

One method of playing the game 10 comprises setting up the game and playing the game. Setting up the game 10 further comprises placing the power source 15 and electrically activated component(s) 16 on the board 12 and the deck of game cards 28 proximate the board 12.

In one embodiment, the power source 15 is placed on or near the center of the board 12 and the electrically activated component(s) 16 are placed at or near the edge of the board. In one embodiment, each player selects an electrically activated component 16 and places his or her electrically activated component on the board 12. In another embodiment, when two players are playing, each player has two electrically activated components 16. In yet another embodiment, if the electrically activated component(s) 16 are already attached to the board, such as when the electrically activated components are permanently attached to the board, each player is assigned an electrically activated component(s), such as by selecting an electrically activated component. This could be done by dice, by drawing a game card with the longest (or shortest) game piece or just by agreement amongst the players.

In one embodiment, the receptacles 20 of the power source 15 and electrically activated component(s) 16 receive pegs 18 from the board 12 to selectively attach the power source and electrically activated component(s) to the board. In another embodiment, the board 12 may include specific spaces for the power source 15 and/or electrically activated component(s) 16.

In one embodiment, the power source 15 is a battery pack and batteries 32 are placed in the battery pack. The electrically activated component(s) 16 is an LED electrically activated component.

The order of the plurality of players, in other words the order in which each player takes his or her turn, is determined, including at least a first player and a second player. In one embodiment, the order is determined by the youngest player going first and then play continues in a clockwise fashion with other players. However, other means of determining an order could be used, such as, for example, rolling a dice, youngest to oldest, playing paper-rock-scissors, etc., without defeating the spirit of the invention.

Figure 17:
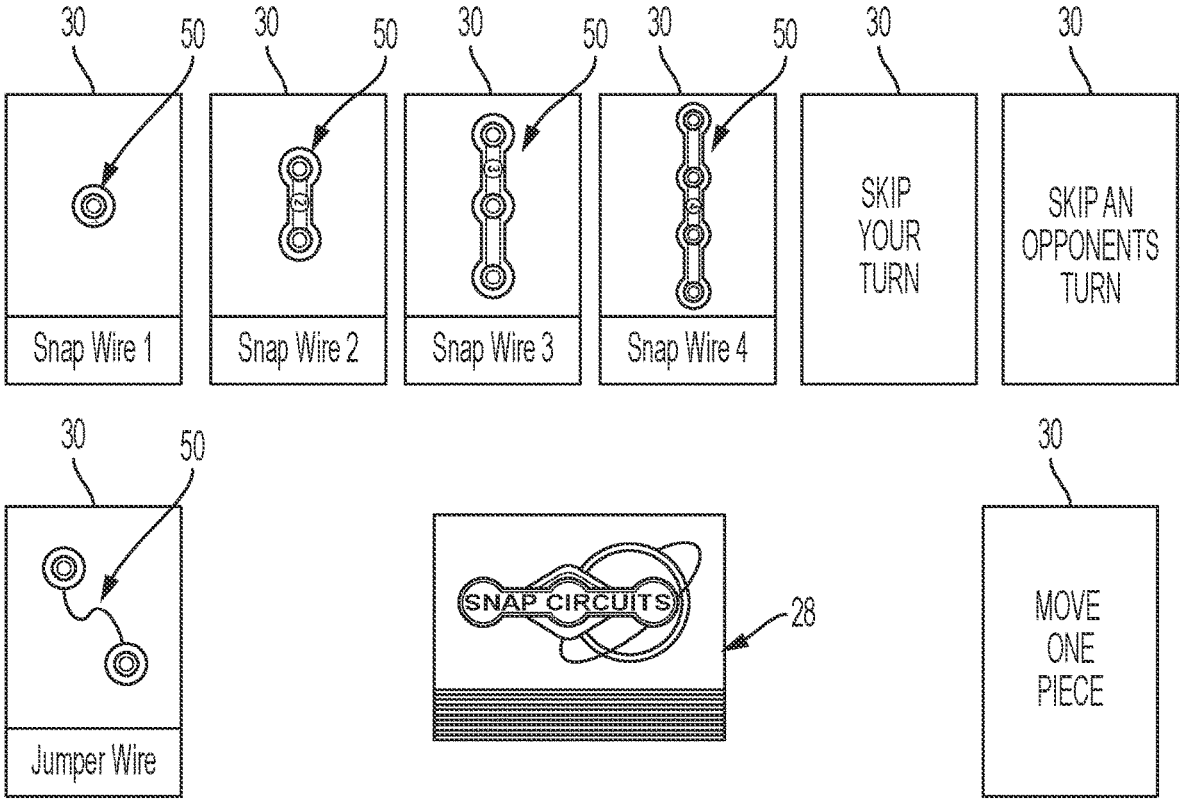
FIG. 17 is a deck of game cards and a number of game cards displaying indicia and/or instructions.
Figure 18:
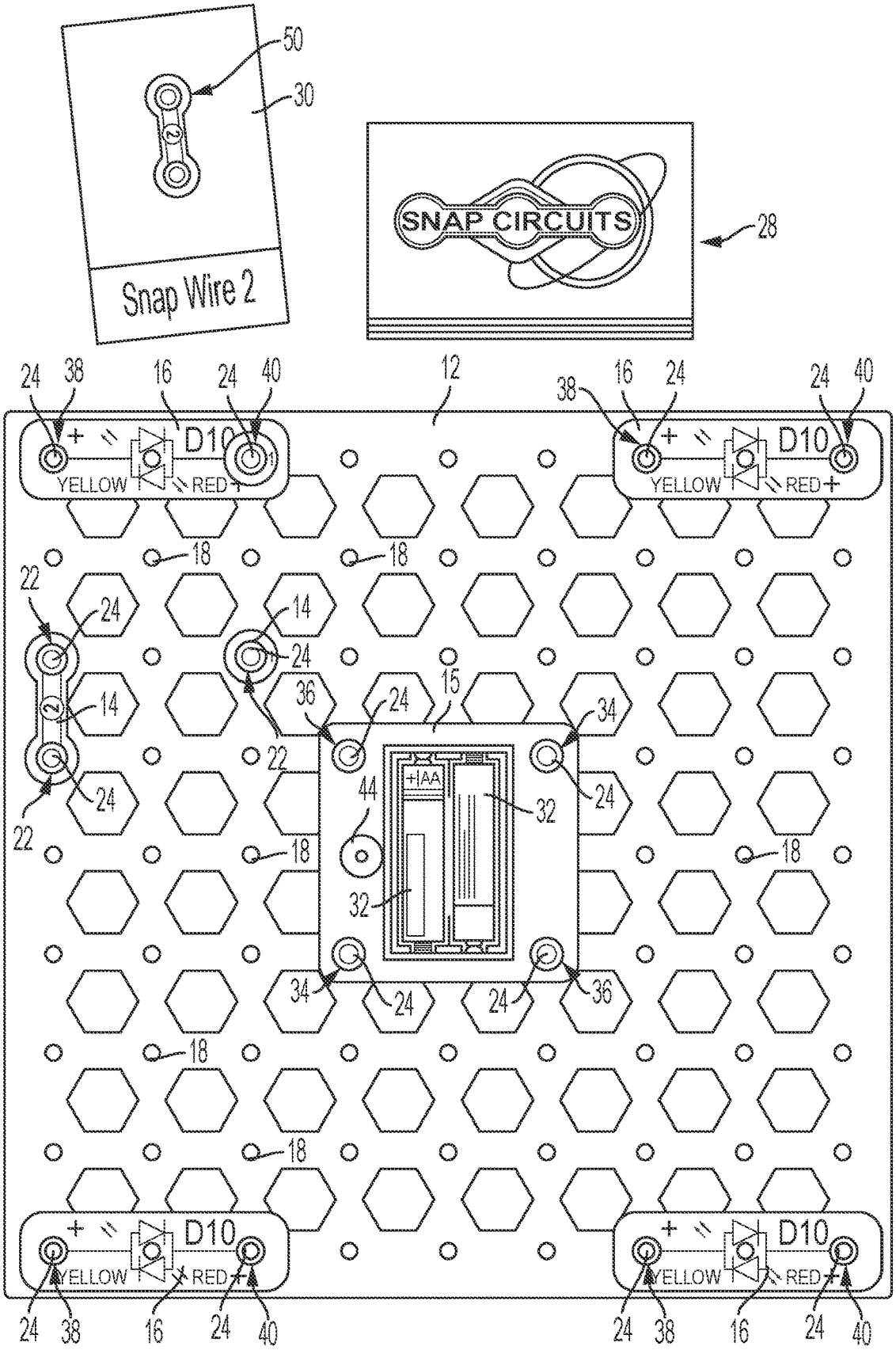
FIG. 18 is a top, plan view of another embodiment of an electric game.
Figure 19:
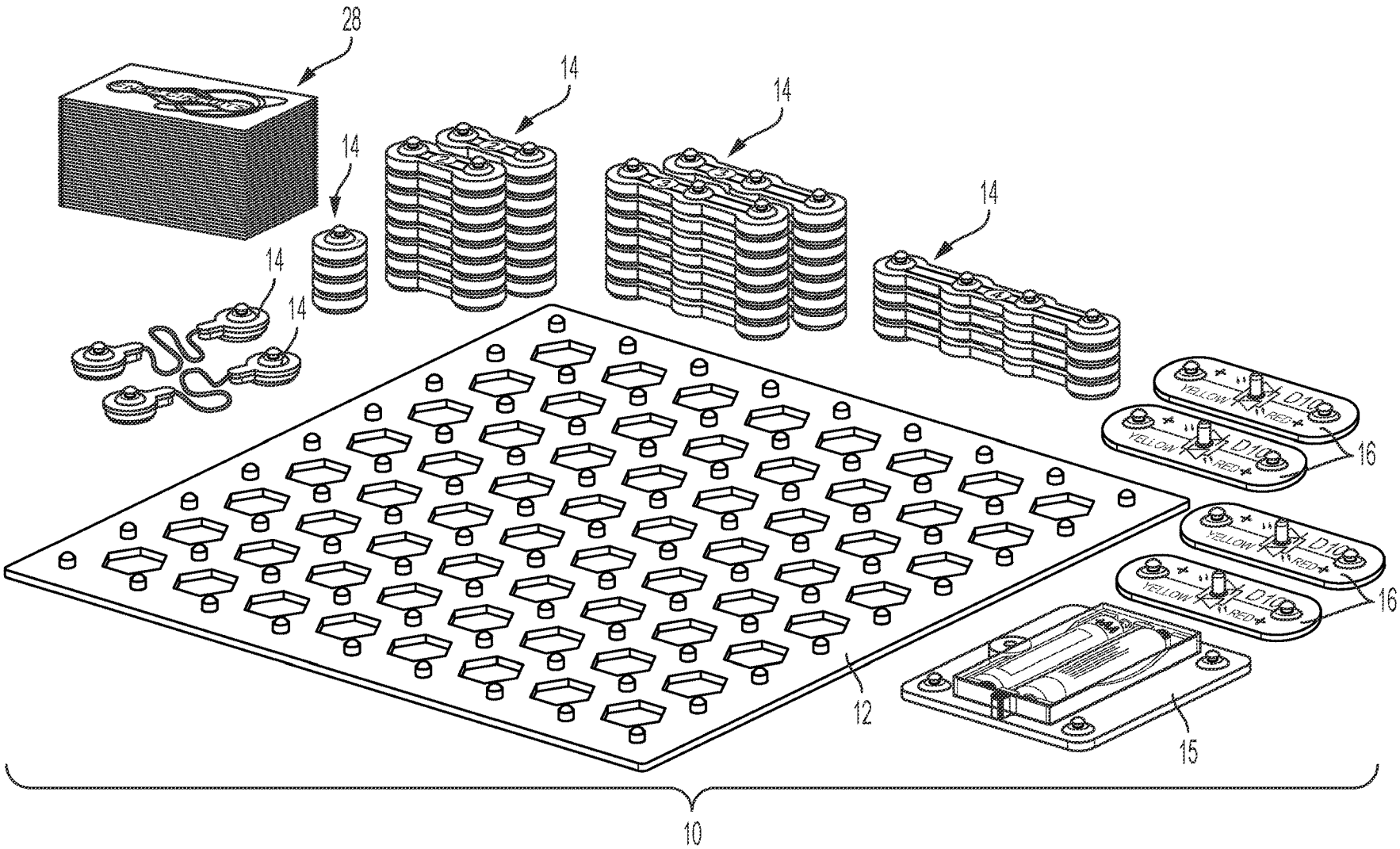
FIG. 19 is a perspective view of one embodiment of an electric game kit.

The first player draws a game card 30 and follows the instruction of the game card as seen in FIG. 17. In one embodiment the instructions comprise an indicia of a game piece 50 and the first player selects a game piece indicated on the card and plays or places the game piece on the board 12. Other instructions can include skipping the player's turn, selecting another player's turn to skip, moving a game piece on the board, or removing a game piece on the board. The instruction to play a game piece 14 may further comprise playing a specific game piece and in one embodiment, to play either a 1-snap, 2-snap, 3-snap or 4-snap game piece. In one embodiment, game pieces 14 are played in a plane parallel to the board 12. For example, if one end of a 2-snap game piece is selectively attached to the top of a first game piece, the second end cannot be attached directly to the board 12. However, other methods of the playing the can be used, including, but not limited to game pieces 14 that are stepped, angled or flexible, such as, for example jumper wires, without defeating the spirit of the invention. In another embodiment, each of the game piece must be connected to either the board 12, another game piece 14, the power source 15 or an electrically activated component 16.

The next or second player then draws a game card 30, unless that player was skipped, and follows the instruction on the game card. A player may place a game piece 14 in order to help him or her complete a circuit 17 or in order to make it more difficult for another player to complete the other player's circuit. In one embodiment, a player may not place a game piece 14 if the placement immediately results in short circuit 42. If the player places a game piece 14 that immediately results in a short circuit 42, the game piece that was played is removed and the game card 30 is returned to the bottom of the deck of game cards 28. In an alternative embodiment, if a player places a game piece 14 that immediately results in a short circuit 42, the player shall remove the game piece, explain why the short circuit was made and play the game piece in another location on the board 12.

In another embodiment, a player may only place a game piece 14 that connects to that player's electrically activated component 16 or another piece that is connected (directly or indirectly) to that player's electrically activated component. Additional rules may be used to keep the game play fair. For example, a player may be prohibited from playing a game piece 14 either over the electrically activated component 16 of another player (and thereby prevent the other player from being able to access the connectors 22 of the electrically activated component such as the plug 24 of the first connector 38 and/or the plug of the second connector 40 of the electrically activated component). A player may also be prohibited from playing a game piece 14 that connects the first connector 38 and second connector 40 of another player's electrically activated component (thereby creating a short circuit when the other player connects the electrically activated component to the power source).

If all of the game cards 30 from the deck of game cards 28 have been used, the game cards are reused, such as by shuffling the deck of game cards, and players resume taking their turns drawing one of the reused game cards. In one embodiment, if the reused game card indicates a game piece 14, the player drawing the game card must move the game piece indicated on the game card from a first position on the board 12 to a second position on the board. In another embodiment, if the reused game card indicates a game piece 14, the player drawing the game card must remove the game piece indicated on the game card from a first position on the board 12 to a second position on the board. In one embodiment, a game piece 14 at least partially located under another game piece cannot be moved. If no game pieces 14 indicated on the game card 30 are eligible to be moved, the turn is skipped. For example, in some embodiments, a game piece 14 is not eligible to be moved if it is located at least partially below another game piece. However, other methods of using the deck of game cards 28 are known, including returning the drawn game card 30 to the bottom of the deck, the use of which would not defeat the spirit of the invention.

The plurality of players take turns and play continues, such as by players selecting a game card and following the instructions on the game card, until a player has made a circuit 17 from the power source 15 to his or her electrically activated component 16 using the game pieces 14 and the electrically activated component is activated. That player is the winning player. In one embodiment, if a player's turn results in the activation of his or her electrically activated component 16 and an electrically activated component 16 for another player, the player that played the game piece 14 is the winner. In the case of a two-player method, if a player electrically activates either of his or her two electrically activated components 16, that player wins.

Another method of playing the game comprises one or more players working together to make a circuit 17 to an electrically activated component 16. In one embodiment, the board 12, power source 15, deck of game cards 28 and at least one electrically activated component 16 is set up like previously described. Players take turns drawing or selecting game cards 30 from the deck of game cards 28 and following each game card's instructions. Once every turn or once every number of game cards, a game card 28 is drawn for the game. If the game card 28 indicates a game piece 14, one of the game pieces indicated by the game card must be removed from the board 12. In another embodiment, the players are trying to make a circuit 17 with the electrically activated component 16 before the deck of game cards 28 runs out.

Another method of playing the game 10 comprises one player trying to make an electrical circuit 17 using the fewest game cards 30, using the fewest game pieces 14 or using the fewest pegs 18 on the board 12. In one embodiment, the board 12, power source 15, deck of game cards 28 and at least one electrically activated component 16 is set up like previously described. The solitary player draws a game card 28, follows the game card's instructions and then draws another game card and follows that game card's instructions until a circuit 17 is made or all of the deck of game cards is used.

Yet another method of playing the game 10 comprises one player trying to make an electrical circuit 17 in which four electrically activated components 16 are electrically activated, such as, for example, lighting the LED components. The solitary player draws a game card 30. If the game card 30 indicates a game piece 14, the player plays the game piece on the board 12. If the game card 30 does not indicate a game piece 14, the player ignores the game card and draws a new game card. Alternatively, all of the game cards 30 but the game cards with game pieces could be removed prior to playing. If a short circuit is created, the game piece 14 just played is removed from the board 12 for the remainder of the game. If the player creates a circuit 17 that electrically activates the four electrically activated components 16, the player wins. If the deck of game cards 28 runs out before the player makes such a circuit 17, the player loses.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. Further, although certain advantages of different embodiments and disadvantages of certain prior art are described, no single claim must realize every or any benefit or overcome every or any disadvantage.

What is claimed is:

1. A game comprising:

a board having a power source at a center of the board, a first electrically activated component at a first edge of the board and a second electrically activated component at a second edge of the board;

a plurality of game cards; and a plurality of electrically conductive game pieces configured to be selectively attached to the board;

wherein a first distance between the power source and the first electrically activated component is equal to a second distance between the power source and the second electrically activated component to promote fair game play;

wherein the power source has a positive connector and a negative connector;

wherein the first electrically activated component has a first component connector and a second component connector;

wherein at least one of the plurality of electrically conductive game pieces is configured to be selectively attached to another one of the plurality of electrically conductive game pieces, the power source, the first electrically activated component, and the second electrically activated component;

wherein the first component connector of the first electrically activated component is electrically connected to the positive connector of the power source by at least one of the plurality of electrically conductive game pieces and the second component connector of the first electrically activated component is electrically connected to the negative connector of the power source by at least another one of the plurality of electrically conductive game pieces, wherein the first electrically activated component is activated.

2. The game of claim 1, wherein the second electrically activated component is not activated.

3. The game of claim 1, wherein the plurality of electrically conductive game pieces are of varying lengths.

4. The game of claim 3, wherein the varying lengths of the electrically conductive game pieces includes a first length and a second length.

5. The game of claim 1, further comprising a third electrically activated component having a first component connector and a second component connector and a fourth electrically activated component having a first component connector and a second component connector.

6. The game of claim 1, wherein each one of the plurality of electrically conductive game pieces further comprises:

a body, the body having a top surface and a bottom surface; and a first connector, the first connector of the each one of the plurality of electrically conductive game pieces having a plug located on the top surface and a receptacle located on the bottom surface;

wherein the plug is electrically connected to the receptacle;

wherein the receptacle is configured to selectively receive a plug from another one of the plurality of electrically conductive game pieces;

wherein the first connector of the each one of the plurality of electrically conductive game pieces is located at a first end of the body; and wherein a second connector of the each one of the plurality of electrically conductive game pieces is located at a second end of the body.

7. The game of claim 6, wherein when the first connector of one of the plurality of electrically conductive game pieces is electrically connected to the second connector of another one of the plurality of electrically conductive game pieces and wherein when the receptacle of the one of the plurality of electrically conductive game pieces receives the plug from the another one of the plurality of electrically conductive game pieces, the one of the plurality of electrically conductive game pieces is electrically connected to the another one of the plurality of electrically conductive game pieces.

8. The game of claim 7, wherein the positive connector of the power source includes a first power plug that is configured to be selectively received by the receptacle of one of the plurality of electrically conductive game pieces; and wherein the negative connector of the power source includes a second power plug that is configured to be selectively received by the receptacle of another one of the plurality of electrically conductive game pieces.

9. The game of claim 8, wherein the first component connector of the electrically activated component includes a first component plug that is configured to be selectively received by the receptacle of one of the plurality of electrically conductive game pieces; and wherein the second component connector of the electrically activated component includes a second component plug that is configured to be selectively received by the receptacle of another one of the plurality of electrically conductive game pieces.

10. The game of claim 1, wherein the power source is configured such that when a short circuit is created, the power source makes a sound.

11. The game of claim 1, wherein the power source is configured such that when a short circuit is created, the power source emits a light.

12. The game of claim 1, wherein the power source is a battery pack;

wherein the electrically activated component includes a first LED; and wherein when the electrically activated component is activated, the first LED emits a light.

13. The game of claim 12, wherein the electrically activated component includes a second LED;

wherein when a voltage is applied to the electrically activated component in a first direction, the first LED emits a light; and wherein when the voltage is applied to the electrically activated component in a second direction, the second LED emits a light.

14. The game of claim 1, wherein at least one of the plurality of game cards includes an instruction from the group consisting of (i) skip a turn, (ii) skip another player's turn, (iii) remove an electrically conductive game piece, and (iv) move an electrically conductive game piece.

15. A kit for a game, the kit comprising:

a board having a first perimeter edge, a second perimeter edge and a center, the board further comprising:

a power source adjacent the center of the board;

a first electrically activated component adjacent the first perimeter edge of the board; and a second electrically activated component adjacent the second perimeter edge of the board;

randomized turn instructions; and a plurality of electrically conductive game pieces;

wherein, the power source has a positive connector and a negative connector;

wherein, the first electrically activated component has a first component connector and a second component connector;

wherein the plurality of electrically conductive game pieces are configured to be selectively attached to the board;

wherein at least one of the plurality of electrically conductive game pieces is configured to be selectively attached to another one of the plurality of electrically conductive game pieces, the power source, the first electrically activated component, and the second electrically activated component; and wherein when the first component connector of the first electrically activated component is electrically connected to the positive connector of the power source by at least one of the plurality of electrically conductive game pieces and the second component connector of the first electrically activated component is electrically connected to the negative connector of the power source by at least another one of the plurality of electrically conductive game pieces, the first electrically activated component is activated.

16. The kit for a game of claim 15, wherein the plurality of electrically conductive game pieces are of varying lengths.

17. The kit for a game of claim 16, wherein the varying lengths of the electrically conductive game pieces includes a first length and a second length.

18. The kit for a game of claim 15, the board further comprising a third electrically activated component having a first component connector and a second component connector and a fourth electrically activated component having a first component connector and a second component connector.

19. The kit for a game of claim 15, wherein each one of the plurality of electrically conductive game pieces further comprises:

a body, the body having a top surface and a bottom surface; and a first connector, the first connector of the each one of the plurality of electrically conductive game pieces having a plug located on the top surface and a receptacle located on the bottom surface;

wherein the plug is electrically connected to the receptacle;

wherein the receptacle is configured to selectively receive a plug from another one of the plurality of electrically conductive game pieces;

wherein the first connector of the each one of the plurality of electrically conductive game pieces is located at a first end of the body; and wherein a second connector of the each one of the plurality of electrically conductive game pieces is located at a second end of the body.

20. The kit for a game of claim 19, wherein when the first connector of one of the plurality of electrically conductive game pieces is electrically connected to the second connector of another one of the plurality of electrically conductive game pieces and wherein when the receptacle of the one of the plurality of electrically conductive game pieces receives the plug from the another one of the plurality of electrically conductive game pieces, the one of the plurality of electrically conductive game pieces is electrically connected to the another one of the plurality of electrically conductive game pieces.

21. The kit for a game of claim 20, wherein the power source includes a first power plug that is configured to be selectively received by the receptacle of one of the plurality of electrically conductive game pieces; and wherein the power source includes a second power plug that is configured to be selectively received by the receptacle of another one of the plurality of electrically conductive game pieces.

22. The kit for a game of claim 21, wherein the first component connector of the first electrically activated component includes a first component plug that is configured to be selectively received by the receptacle of one of the plurality of electrically conductive game pieces; and wherein the second component connector of the first electrically activated component includes a second component plug that is configured to be selectively received by the receptacle of another one of the plurality of electrically conductive game pieces.

23. The kit for a game of claim 15, wherein the power source is configured such that when a short circuit is created, the power source makes a sound.

24. The kit for a game of claim 15, wherein the power source is configured such that when a short circuit is created, the power source emits a light.

25. The kit for a game of claim 15, wherein the power source is a battery pack;

wherein the first electrically activated component includes a first LED; and wherein when the first electrically activated component is activated, the first LED emits a light.

26. The kit for a game of claim 25, wherein the first electrically activated component includes a second LED;

wherein when a voltage is applied to the first electrically activated component in a first direction, the first LED emits a light; and wherein when the voltage is applied to the first electrically activated component in a second direction, the second LED emits a light.

27. The kit for a game of claim 15, wherein the randomized turn instructions include at least one card having an instruction from the group consisting of (i) skip a turn, (ii) skip another player's turn, (iii) remove an electrically conductive game piece, and (iv) move an electrically conductive game piece.

* * * * *